United States Patent [19]

Vitols et al.

[11] Patent Number: 4,463,581

[45] Date of Patent: Aug. 7, 1984

[54] KNITTING PROCESS AND MACHINE

[75] Inventors: Reinhards Vitols, Tollerton; Steven Walkinshaw; Gordon R. Wray, both of Loughborough, all of England

[73] Assignee: National Research Development Corporation, London, England

[21] Appl. No.: 344,035

[22] Filed: Jan. 29, 1982

[30] Foreign Application Priority Data

Jan. 29, 1981 [GB] United Kingdom ..... 8102718

[51] Int. Cl.[3] ..... D04B 23/02

[52] U.S. Cl. ..... 66/87; 66/190; 66/193

[58] Field of Search ..... 66/78, 87, 88, 190, 66/193

[56] References Cited

U.S. PATENT DOCUMENTS

| | | | |
|---|---|---|---|
| 1,286,349 | 12/1918 | Kopp | 66/87 |
| 3,355,911 | 12/1967 | Landgraf | 66/87 X |
| 3,376,835 | 4/1968 | Watkins | 66/85 A X |
| 3,401,657 | 9/1968 | Watkins | 66/85 A X |
| 3,522,716 | 8/1970 | Palange | 66/87 |
| 3,952,550 | 4/1976 | Niederer | 66/87 |

FOREIGN PATENT DOCUMENTS

| | | | |
|---|---|---|---|
| 510123 | 11/1920 | France | 66/87 |

*Primary Examiner*—Ronald Feldbaum

*Attorney, Agent, or Firm*—Oblon, Fisher, Spivak, McClelland & Maier

[57] ABSTRACT

A knitting technique in which opposed needles reciprocate towards and past one another in a time-varying motion which is at least principally lengthwise of the needle. One needle approaches and picks up a yarn-end from another needle and forms a loop in the yarn and over the one needle while the other needle withdraws. The other needle then approaches in its turn to pick up a yarn-end and form a further loop while the one needle sheds its loop on to the yarn-end now picked up to form the further loop, the cycle continuing to produce a seam of linked loops. Shogging action by needles and/or associated yarn-control elements produces seam interaction to link seams weft-wise as a knitted fabric. More complex interaction produces patterned fabrics and other knits where yarns link across several wales. An apparatus to carry out the technique includes a needle motion drive using linkages to produce a durable and precise drive action.

35 Claims, 31 Drawing Figures

"BASIC"

"ALTERNATIVE"

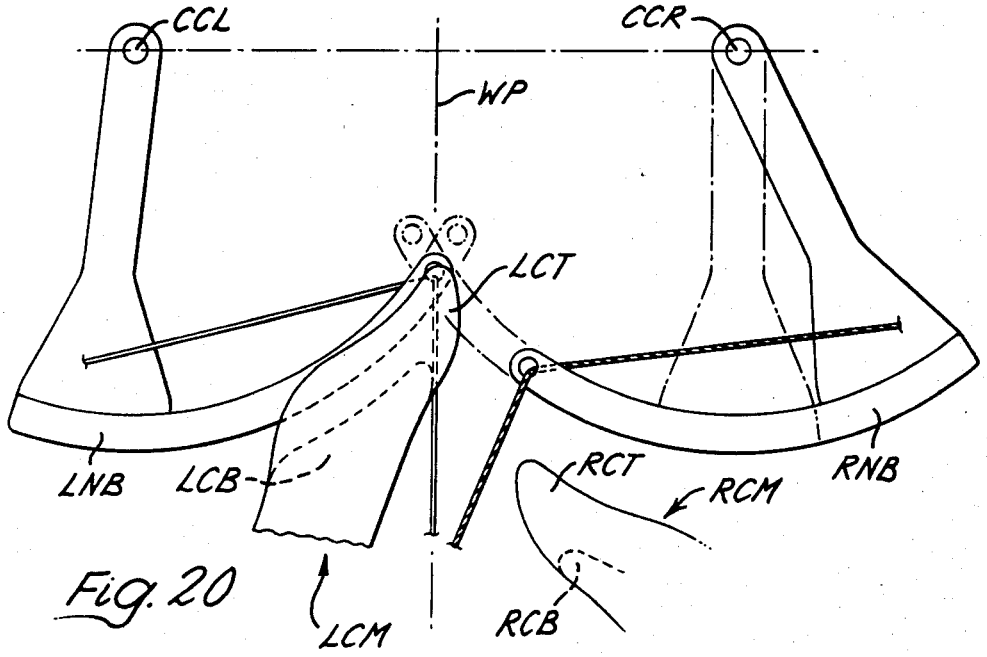
Fig. 20
Fig. 21
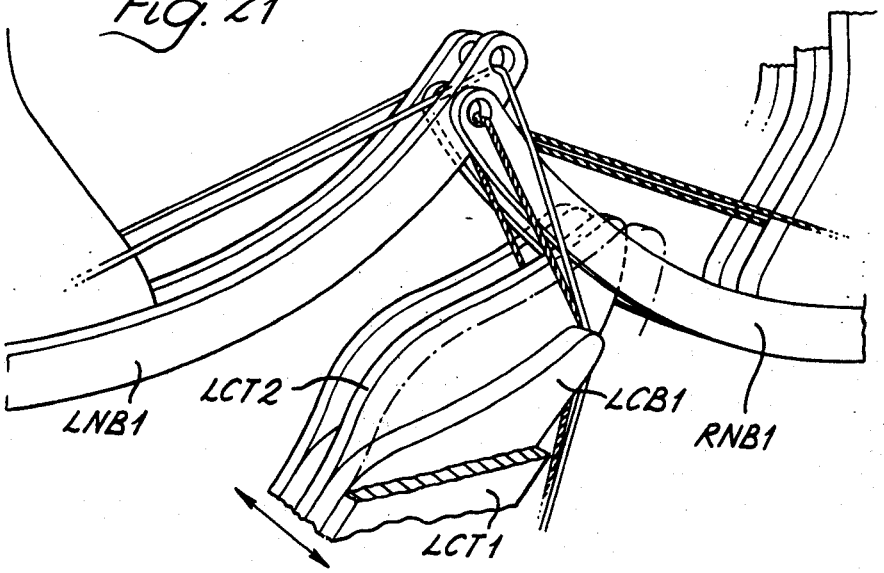

KNITTING PROCESS AND MACHINE

This invention relates to the knitting of yarns.

Knitting of yarn is a process well adapted to the production of fabric at high speed. However there is strong demand for further increases in speed of production and for knitted fabrics of new appearance and characteristics, or having the properties of fabrics made by other processes. The loop-forming step is fundamental to knitting and if this can be speeded or simplified production rates could rise. There are constraints on the loop-forming step in existing machinery which limit the loop arrangements and the designer's freedom of choice in fabric design.

Furthermore there are requirements for machines to produce fabrics from yarns of materials that are difficult to handle. Thus short staple cotton yarn liberates a lot of fluff when handled, clogging up conventional knitting or weaving machines. Other yarns such as those of glass fibre, carbon fibre or proprietary materials such as KEVLAR (R.T.M.) raise special requirements when they have to be made into reinforcing webs or similar open weave materials. Another requirement is for the production of open-weave bandage for medical use.

Among various knitting machine constructions which have been proposed are firstly those described in "The Textile Mercury and Argus" Sept. 6th 1957, page 384 and 385 and Italian Pat. No. 571,889 to Walter Palange and secondly, those described in DS-OS Nos. 2,128,074 and 2,128,075 to Fa. Jean Gusken (Inventor Walter Palange). These machine constructions have generally sickle-shaped needles of channel section each with a terminal yarn eye. The needles are arranged in opposed banks. Each bank is supported on a lengthwise shaft some distance from the needle eyes and in the plane of the needle bank so that the whole bank can swing on the shaft and each needle eye thus moves in a circular arc with the bank as a radius. The arcs of each needle bank are arranged to intersect. The needles thus have a "nodding" action.

The needles are driven to swing past each other to form and knock over loops of yarn as a linked chain of loops from each pair of needles (one needle of each bank). The loops are held behind the sickle-shaped part of the needle for part of the swing. The chains can be cross-linked by a racking or shogging motion of one needle pitch of one bank of needles with respect to the other. Machines of the general type described have produced textiles in various forms; however it has been found that when employing these techniques with yarns required for high speed production of fabric it is possible for loops not to be formed properly. This can result in a "run" of loosened loops through the fabric making much waste fabric and loss of production and material.

Also, while the use of channel-section needles, as in the prior art mentioned above, can produce usable fabrics with some yarns, the extra width of needle required to provide the channel section limits the fineness of knitting that can be done. The use of modified needles, e.g. UKPS 999,048, permits a smaller yarn pitch and fabrics of finer yarns. However the needles still require some extra yarn retaining means which makes the machine more difficult and time-consuming to set up and operate, e.g. when a yarn breaks. The channel-section needles of the prior art technique are apparently essential so that the yarn between the supply and the eye is kept away from the yarn between the eye and the fabric.

The arcuate swinging motion of the needles may also necessitate the sickle-shaped needle form and the "nodding" action bends the chain of knitted loops from side to side and causes some variation in loop tension. The channel section and sickle shape together set considerable fabrication problems for needle makers, which increase the cost and complexity of manufacture and operation.

It is an object of the invention to provide a knitting process of improved production, speed and versatility with reliable loop formation and pick-up.

According to the invention there is provided a knitting process including causing two opposed yarn supply needles to reciprocate towards one another with a motion wholly or at least principally lengthwise, supplying yarn to said needles, tensioning yarn-ends of yarn fed through the needles to control the yarn-ends, arranging for one needle to move forward with its yarn past the yarn-end from the other needle to pick up and hold a yarn loop of said yarn-end from the other needle, arranging for the other needle to withdraw leaving the picked up loop held on the one needle, arranging for the one needle to withdraw in turn with the picked up loop to shed the held loop to link it with the yarn-end of the one needle, continuing the reciprocation to produce a sequence of linked loops of yarn by similar action of both needles.

The process may in a continued knitting action add two linked loops of yarn to a length of knitted linked loops by one reciprocation of each needle.

A plurality of needles may be provided and arranged in opposed banks to operate the process to produce a plurality of sequences of warp-wise linked loops. The yarn-ends may be manipulated to produce weft-wise linking of picked up loops of the sequences of warp-wise linked loops as a knitted fabric.

The yarn-ends may be manipulated by relative side-to-side movement (shogging) of the needles, by yarn control elements or by a combination of both actions.

Advantageously in the process the yarn is also manipulated by grabbers (as herein defined) both to knock over the loops and to hold yarn to be picked up by a needle.

According to one particular aspect of the process two groups of needles, and grabbers if required, are reciprocated to cross one another and at least one group is caused to shog at least one needle space to link picked up loops weft-wise as well as warp-wise as a knitted fabric.

According to another particular aspect of the process two groups of needles are caused to reciprocate without a shogging motion along crossing axial paths and two associated groups of yarn control elements are caused to shog to move linked loops of yarn at least one needle space to link picked up loops weft-wise as well as warp-wise as a knitted fabric. The axial paths may be straight or curved.

According to a particular aspect of the invention there is also provided knitting apparatus including opposed banks of yarn-looping needles, means to support the needles for reciprocal movement, means to move the needles at time varying speed in paths for the respective banks including at least a principal motion lengthwise of the needles in a bank, the paths of needles of each bank intersecting in the principal motion, means to supply yarn to the needles and means to tension and take up yarn from the needles to control this yarn, the arrangement being such that yarn supplied through needles of each bank is linked in loops with yarn supplied through needles of the other bank by the continued motion of the needles.

The needles are conveniently straight, at least in the part used for yarn manipulation. The needles may be moved in crossing orbits around the principal motion including motions laterally and transversely of the needles in the bank. The general directions of movement of the one needle and the other needle may each be inclined at an acute angle up from the horizontal. The angle may be less than 45°.

There may be a yarn control element for each needle to control the yarn end from the needle. This element in one form is referred to as a "grabber".

The yarn control elements may be in the form of combs, one beneath each group of needles, which groups may be arranged to intersect at right angles. The combs alone may shog to place a yarn-end for pick-up to form a loop. The needles for such combs may be arranged for motion only in a lengthwise direction. When the needles are straight the motion is thus along the straight line in which the needle lies. When the needle is curved to a circular arc form, the motion is along the circular arc in which the needle lies. The combs may include portions to form yarn take-down guides.

The apparatus according to the invention may include spaced side frames, opposed drive mechanisms supported between the side frames together with yarn supply means and knitting pull-down means, opposed needle banks supported by the drive mechanisms for co-ordinated drive thereby in a principal motion of reciprocation lengthwise of the needles in each bank and towards the opposite needle bank, the drive mechanisms also including means to drive the supported needle banks in a subsidiary motion to cause the needles to move in orbit around the longitudinal direction, slide means in the supports of the needle banks for the drive mechanisms to permit motion of the needle banks laterally of the direction of the principal shogging motion and shogging drive means to drive the needle banks in said lateral direction, yarn control elements flexibly supported by the drive means for drive by the shogging drive means in said lateral direction, the drive mechanisms including cam means and linked lever means to produce cyclically said principal and orbital motions of the needle banks with a variation of the needle speed in a cycle, the needle movements taking the needles of each bank in turn between the needles of the other bank to execute a knitting action linking loops formed in yarn supplied to the needles and the apparatus including means to synchronise the action of the drive mechanisms with the action of the shogging drive means to produce lateral interaction of the knitting action on the supplied yarn to form in operation a knitted fabric.

The apparatus according to another aspect of the invention may include opposed groups of needles arranged in banks, each needle curved in a circular arc out of the plane of the banks, means to support the opposed banks and reciprocate them towards one another at a non-constant speed along the arcs of curvature of the needles in the banks, yarn control means outside these arcs of curvature with means to drive the yarn control means into and out of the reciprocating needle banks and to drive the yarn control means along the needle banks, when disengaged therefrom, in a yarn knitting action, yarn supply means, means to draw yarn-ends from the supply through the needles for knitting action by the operation of the needles and yarn together with control means, the yarn control means being arranged to hold yarn being drawn from the needles of one bank across the path of approaching needles of the other bank for the approaching needles to pick up and form respective loops with the yarn on their yarn as the yarn knitting action.

The yarn control means may be in the form of a comb, that is teeth on a support member with the teeth at the pitch of the needles, the teeth to receive yarn extending from the needles and the support member to enable the control means to hold the received yarn for needles of the other bank to pick up.

The yarn control means may also form a take-down guide for knitted yarn. The loops picked up and formed by the needles are not distorted by the reciprocation of the needles as the needles move in their arc of curvature.

The apparatus may include yarn control elements, grabbers, interdigitated with the needles in a bank and supported for movement in relation to the needles in the bank and about the needles to pass over a needle to move a loop along the needle and to hold yarn passing to the take-up means in a controlled position for linking in loops by a needle.

According to the invention there is further provided knitting apparatus including opposed banks of yarn-looping needles each supported for reciprocal movement in a straight line, the lines crossing, means to supply yarn to the needles and means to tension and take up yarn from the needles and yarn control elements supported for movement sideways of the needles with yarn from the needles, the arrangement being such that yarn supplied to a needle of one bank is linked in loops with yarn supplied to a needle of the other bank by the continued motion of the needles in crossing reciprocal motion and the movement of the yarn control elements.

The apparatus may be arranged to produce knitted fabric by the sideways movement of the needles and the yarn control elements being extended to bring about weft-wise linking of picked up loops.

Yarn may be laid into the seams or fabric formed by interaction of the seams in a warp-wise and/or weft-wise sense.

According to yet another particular aspect of the process two opposed groups of curved needles are caused to reciprocate along crossing arcs coincident with the curvature of the needles to form by the process linked yarn loops outside the arcs, and two associated groups of yarn control elements are caused to shog to move yarn-ends from one group of needles across the approaching needles of the other group for pick-up by said other group of needles to form linked loops of yarn.

Conveniently the yarn control elements also control the position of the yarn-ends in the plane of curvature of the needles.

In the process where linked loops are formed by the shogging action of the yarn control elements a needle group may be shogged in addition to produce selected seam interaction in a fabric.

According to the invention there is further provided a knitting process in which two yarn supply needles are caused to reciprocate towards one another with a motion wholly or at least principally lengthwise, one needle to move forward with its yarn past the yarn-end from the other needle to pick up and hold a yarn-loop of said other yarn on the withdrawal of the other needle, the one needle to withdraw in turn with the picked up loop to link the picked up loop with the yarn of the one needle, the reciprocation continuing to produce a sequence of linked loops of yarn by similar action of both needles.

Embodiments of the invention will now be described with reference to the accompanying drawings in which:

FIGS. 1*a* and 1*b* show a pair of stitch forms;

Figure 3A:
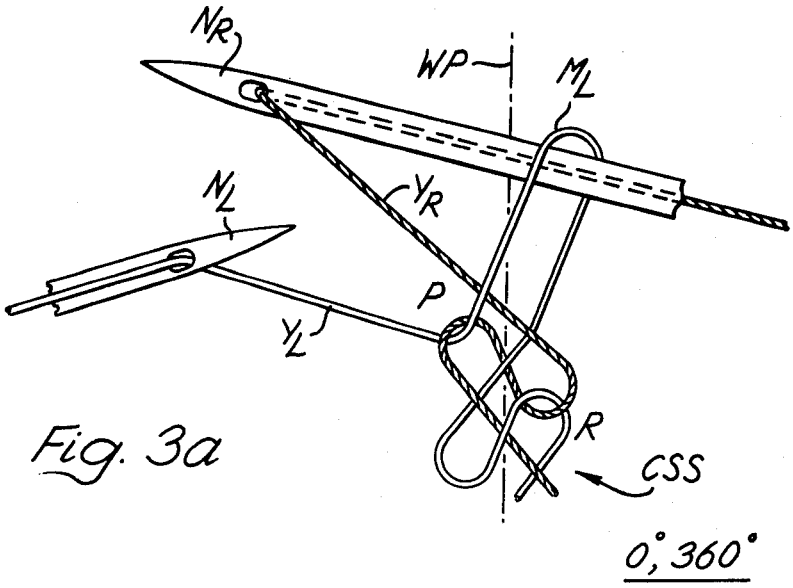
FIG. 3 shows a six stages (3*a* to 3*f*) in the knitting of the stitch form of FIG. 1*a* with the needle motions of FIG. 2.
Figure 3B:
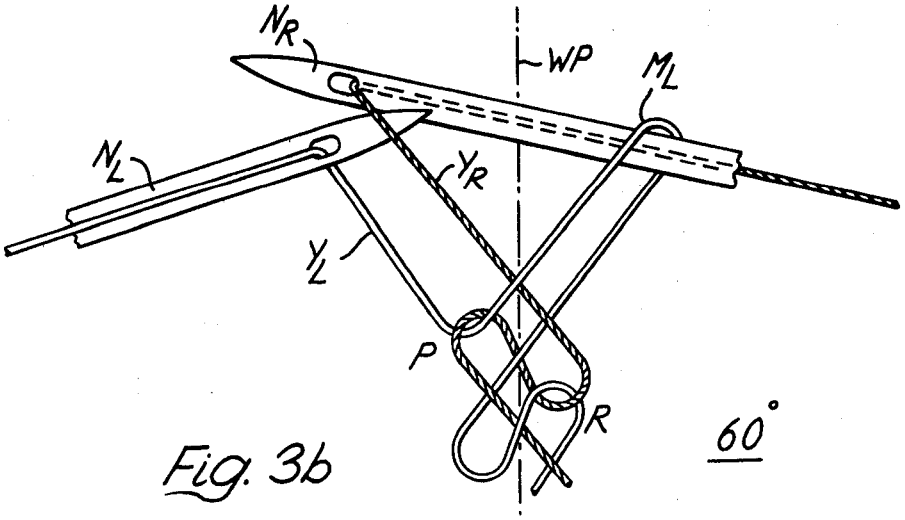
Figure 3C:
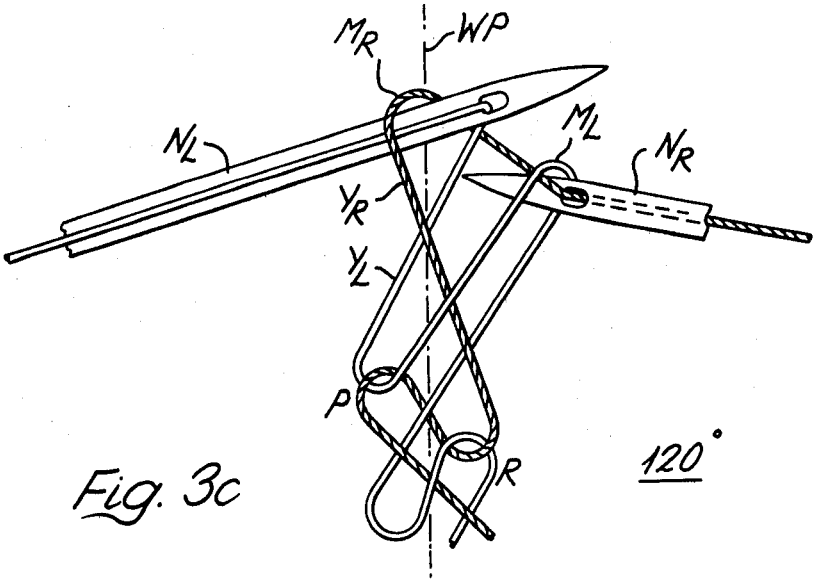
Figure 3D:
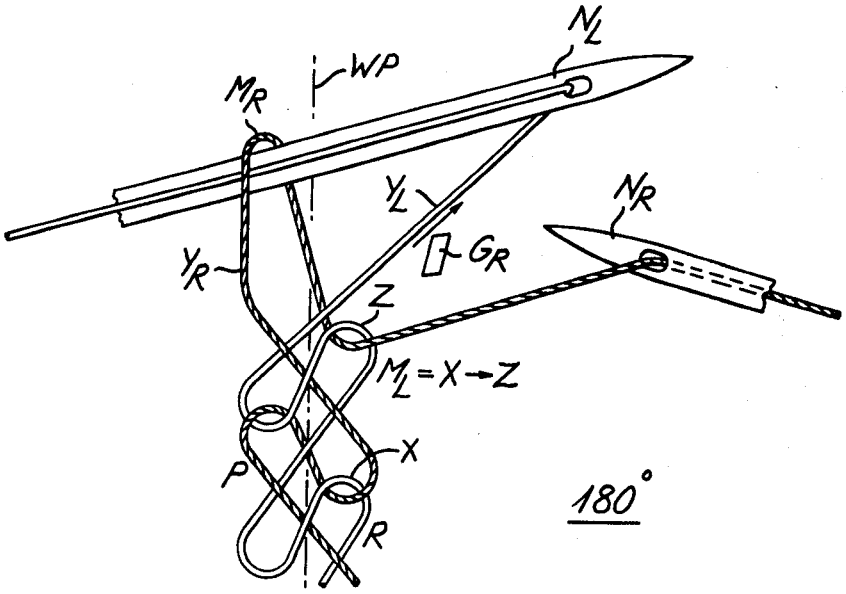
Figure 3E:
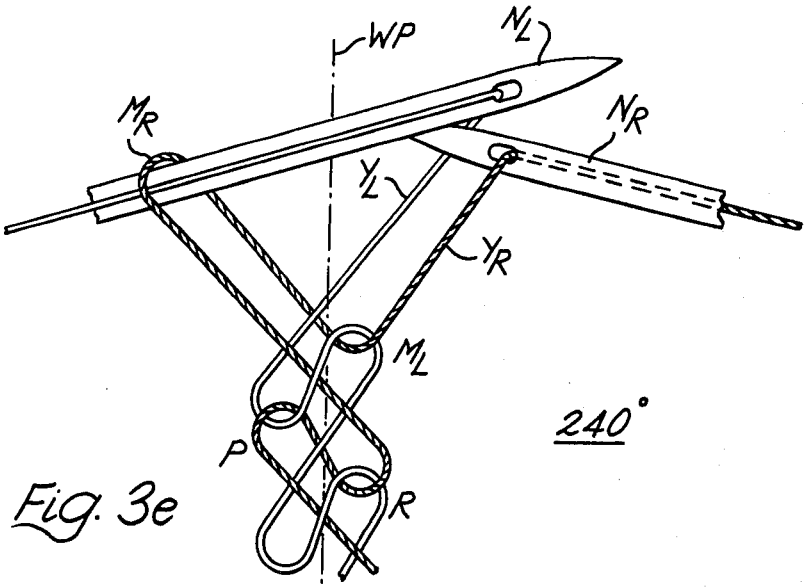
Figure 3F:
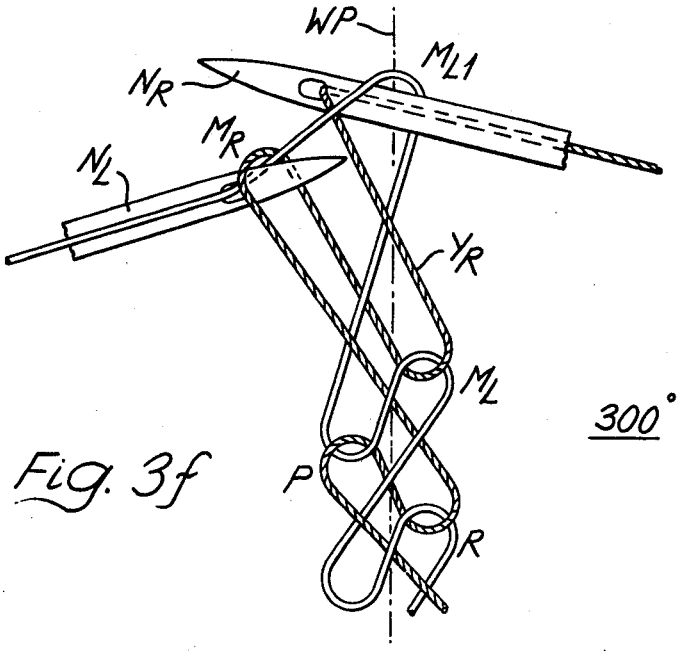
Figure 3G:
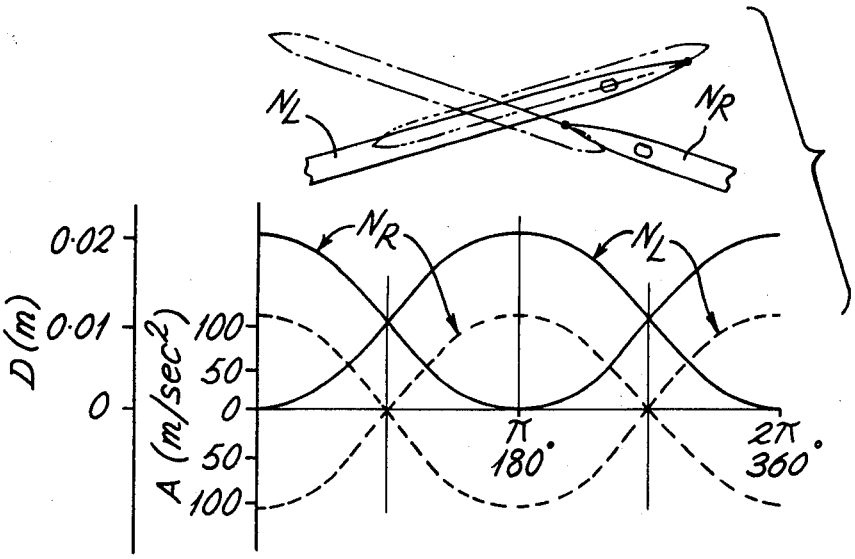

FIG. 3*g* shows the needle motion in graphical form.

Figure 1A:
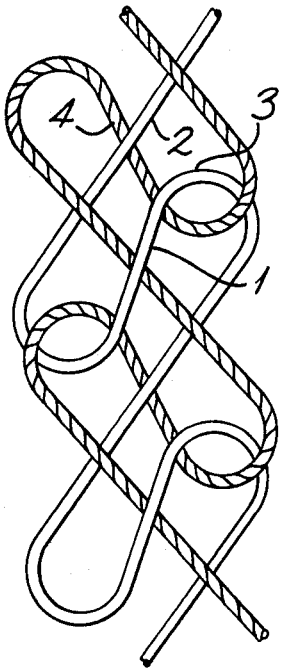
Figure 4:
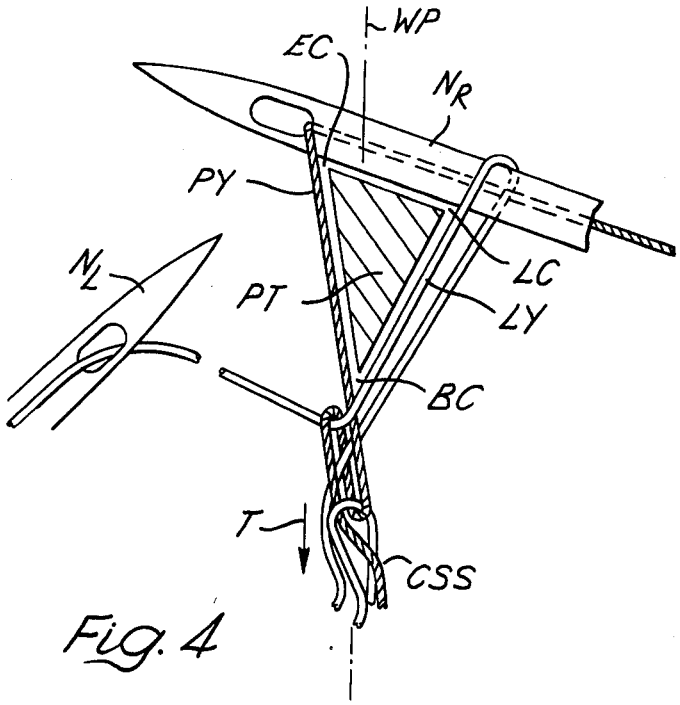
Figure 5A:
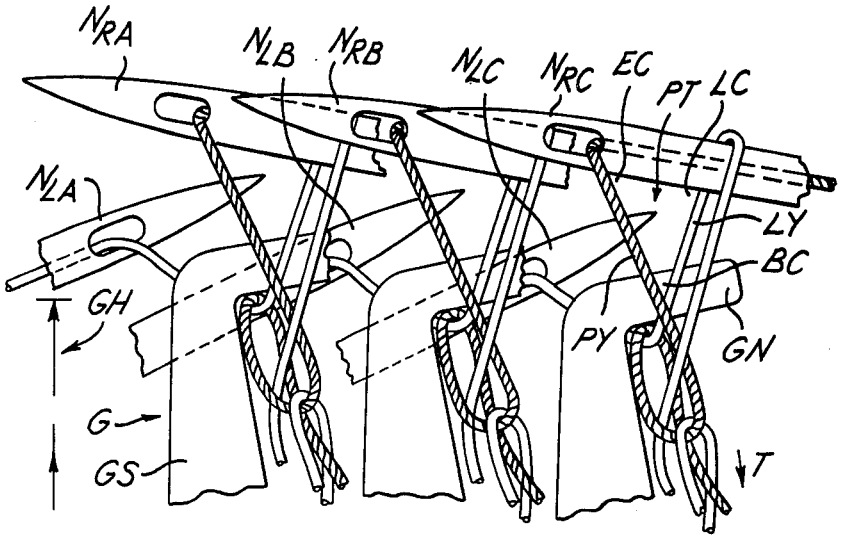

FIG. 4 shows in more detail one needle and the yarns from both needles at one stage during knitting;

FIG. 5*a* shows several needles and associated "grabbers" knitting respective distinct "seams" of two-yarn chain stitches of the type in FIG. 1*a;*

Figure 6:
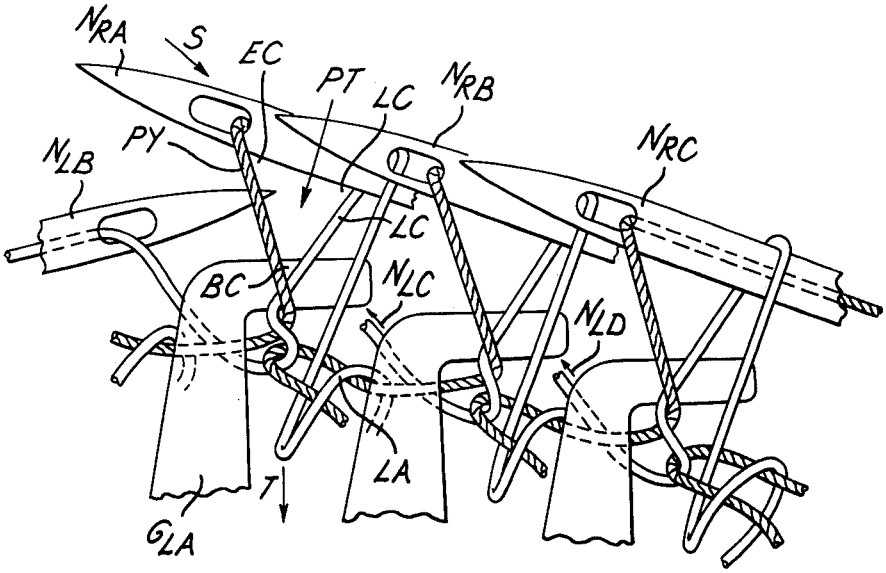
Figure 5B:
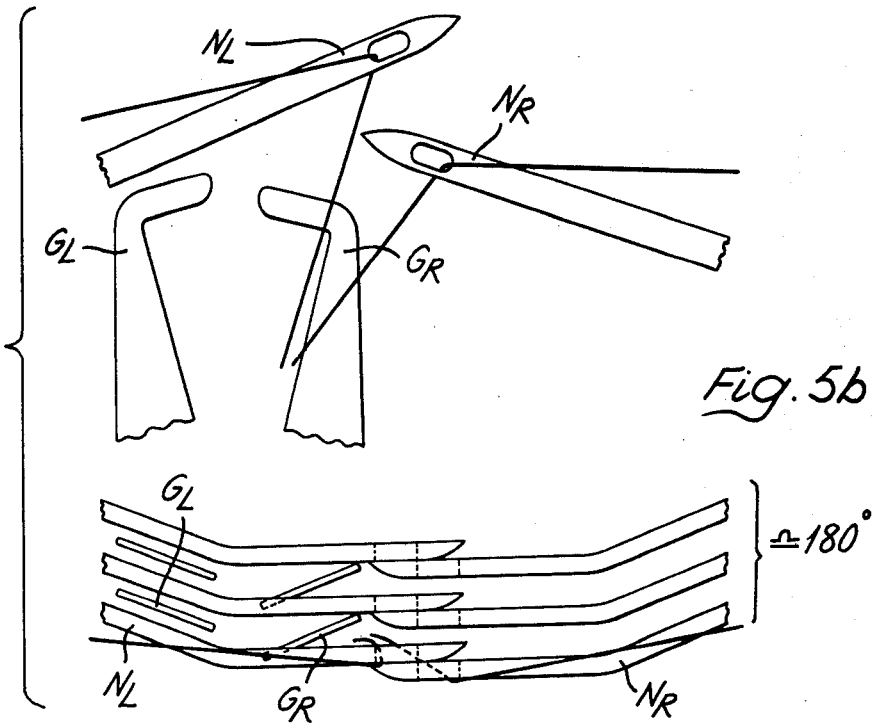
Figure 5C:
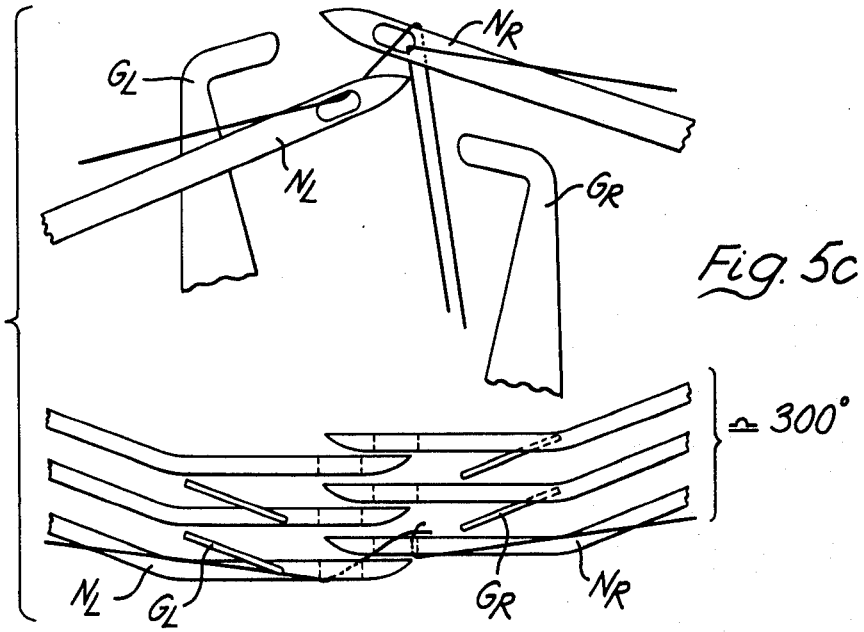
Figure 7:
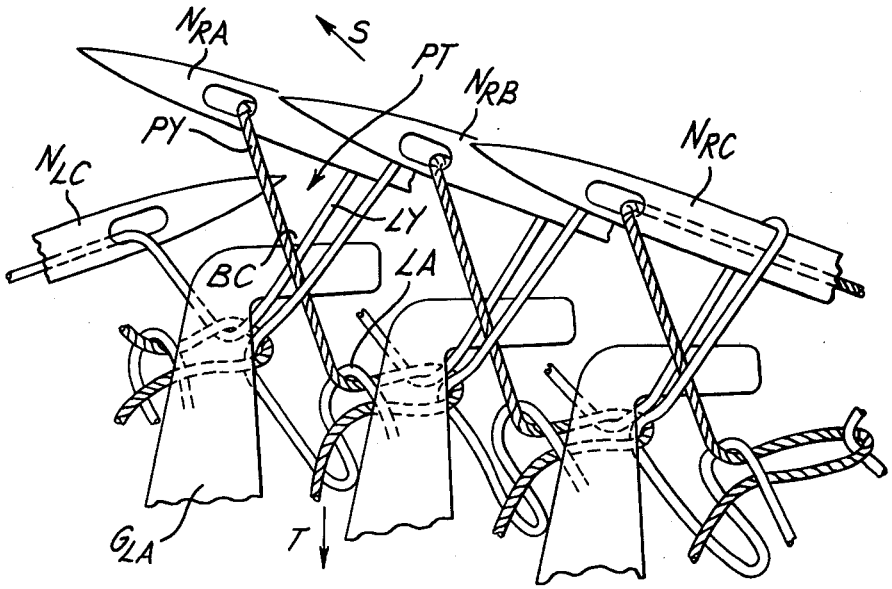
Figure 8:
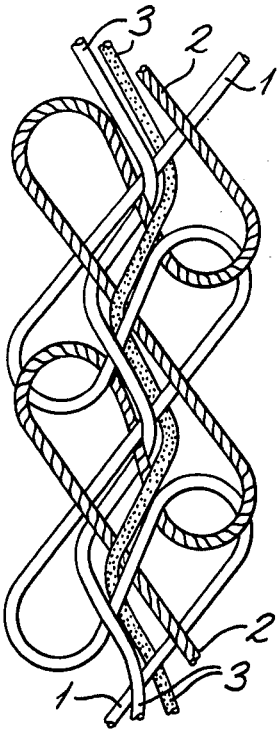
Figure 9A:
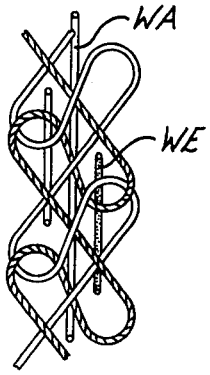
Figure 9B:
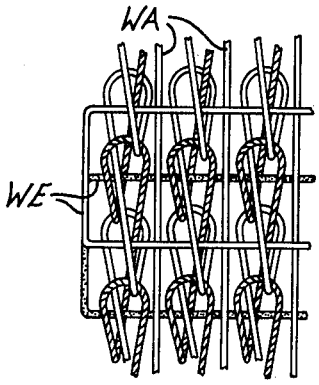
Figure 10:
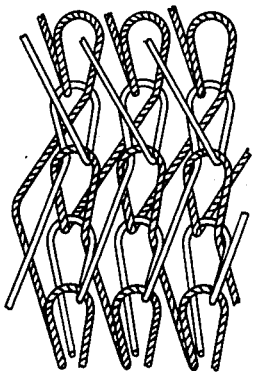
Figure 11:
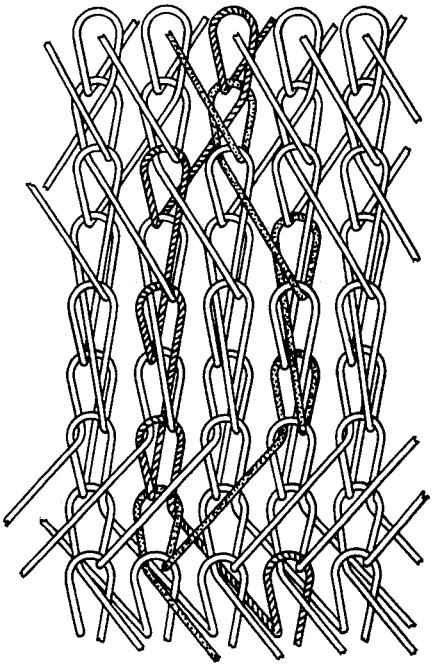
Figure 12:
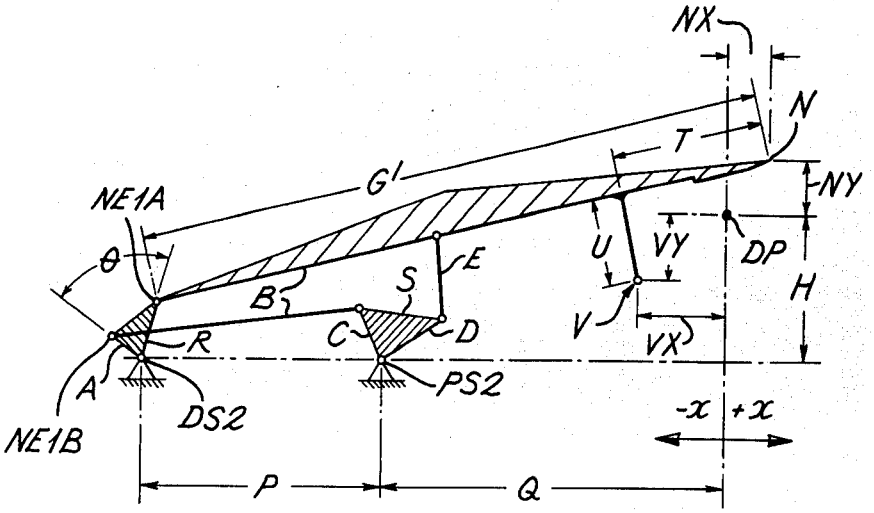
Figure 13:
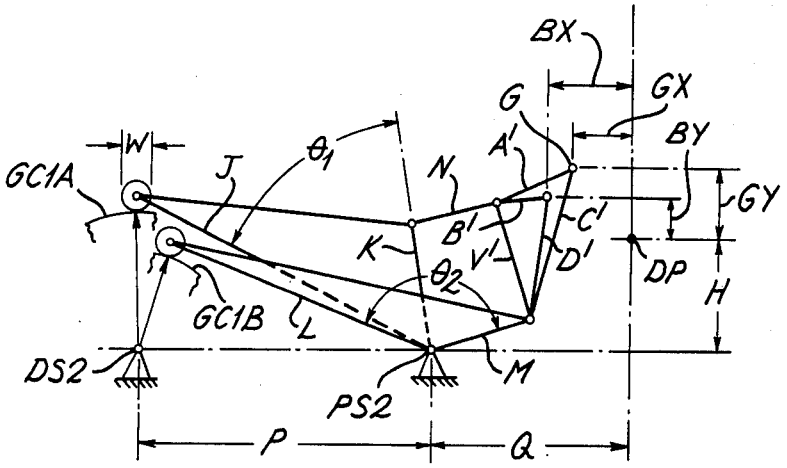
Figure 14A:
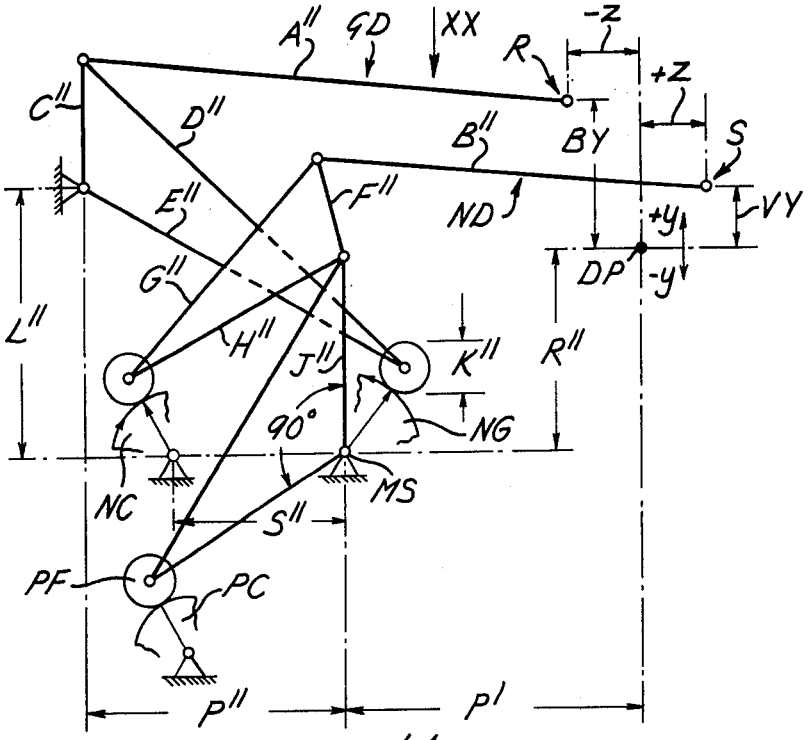
Figure 14B:
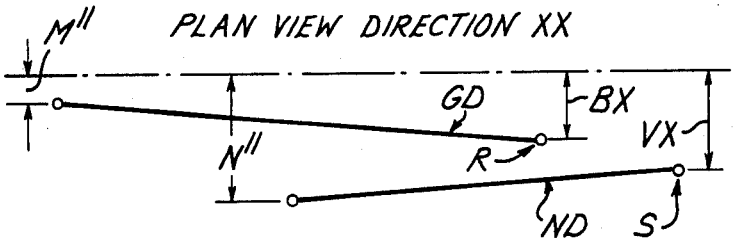
Figure 15:
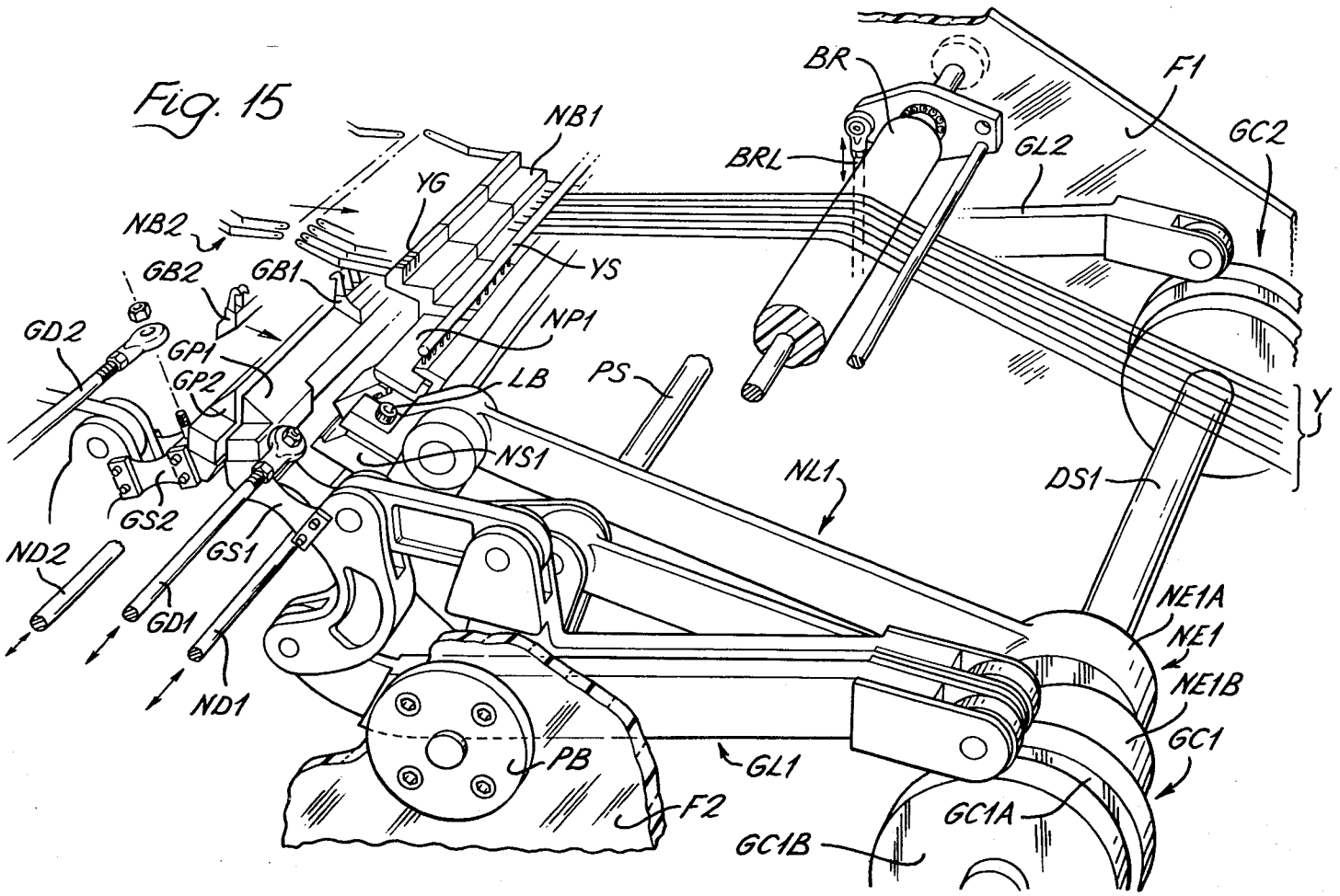
Figure 16B:
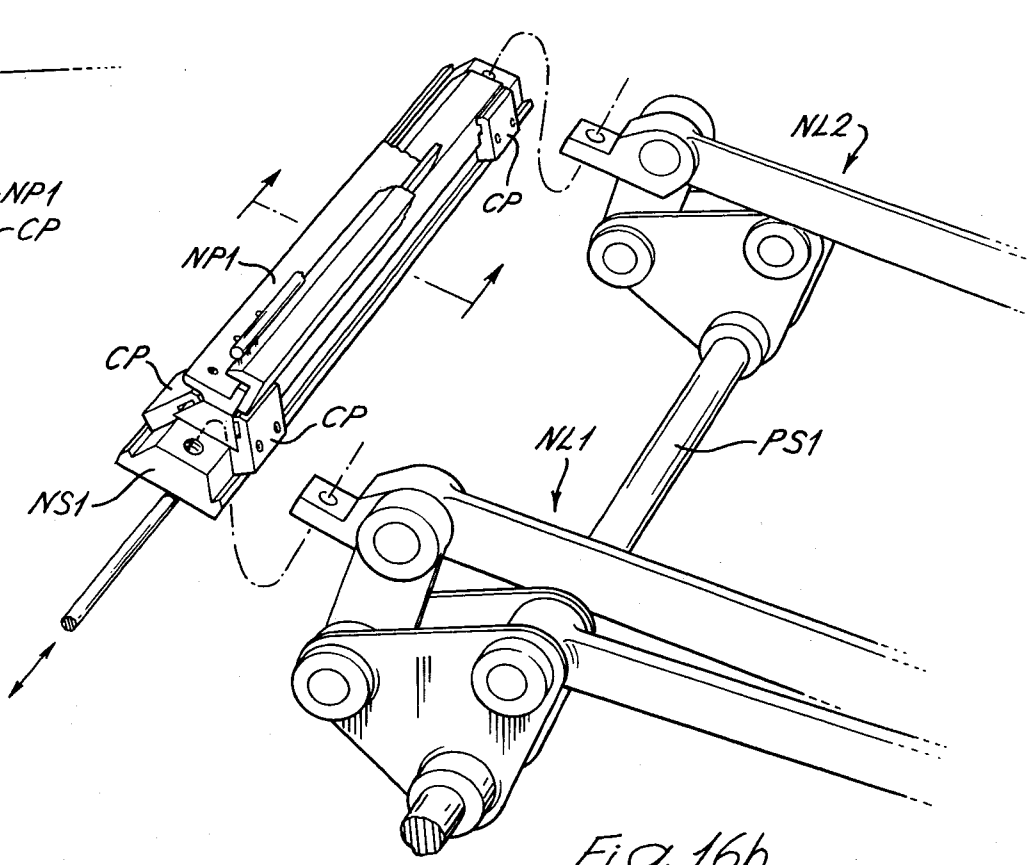
Figure 16A:
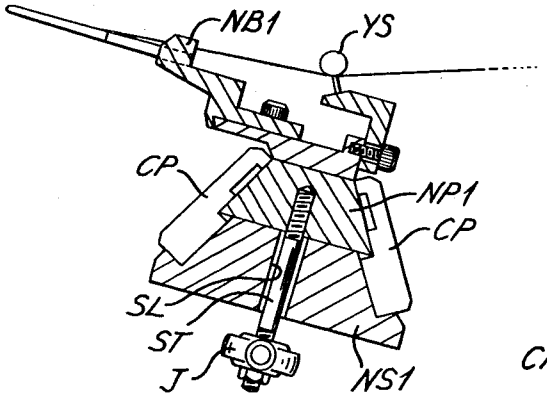
Figure 17:
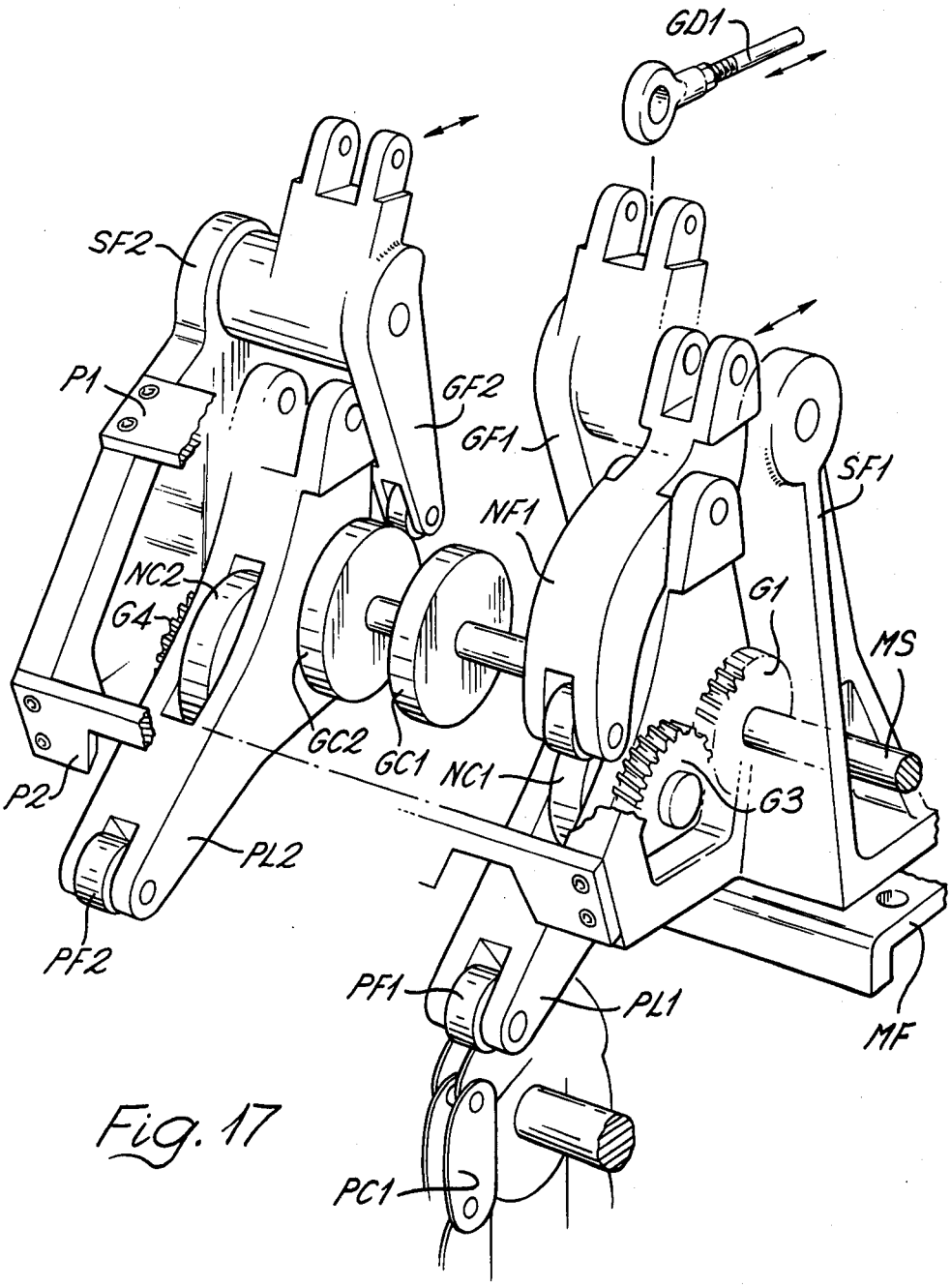
Figure 18:
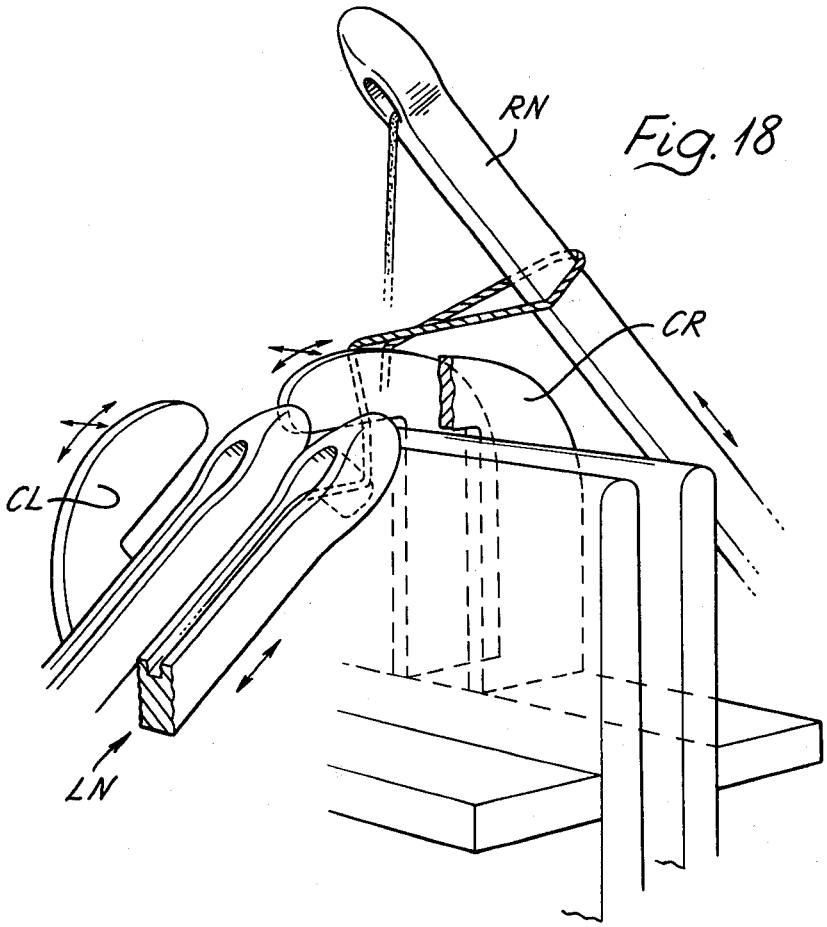
Figure 19:
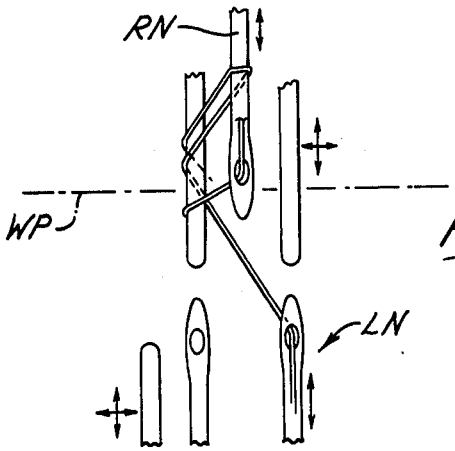

FIGS. 5*b* and 5*c* are each plan and elevation views of the FIG. 5*a* arrangement, but at different points of operation;

FIGS. 6 and 7 show two stages of several needles and associated "grabbers" knitting respective "seams" of the FIG. 1*a* type with loops intermeshed between seams forming wales of a knitted fabric;

FIG. 8 shows a knitted seam with a laid-in warp;

FIGS. 9*a* and 9*b* show in end and side elevation respectively knitted seams with added warps and wefts;

FIG. 10 shows knitted seams with seam loops regularly intermeshing adjacent wales;

FIG. 11 shows knitted seams with seam loops intermeshing spaced wales in a required design;

FIGS. 12, 13 and 14 show in outline the needle and grabber movements provided in a knitting apparatus embodying an aspect of the invention;

FIGS. 15, 16 and 17 show views of parts of a machine to knit fabrics in accordance with the invention using the "alternative" stitch form;

FIGS. 18 and 19 show an alternative mechanism to knit fabrics in accordance with the invention;

FIGS. 20 and 21 shows a further mechanism to limit fabrics in accordance with the invention.

Figure 1B:
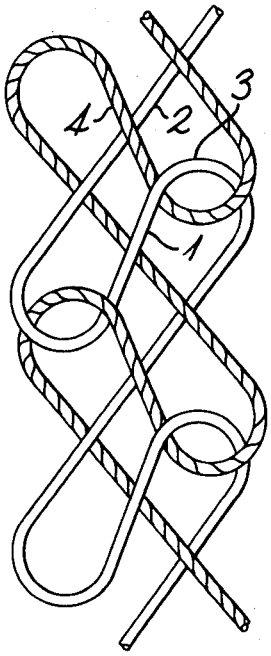

FIGS. 1*a* and 1*b* show a pair of stitch forms according to the invention for convenience that in FIG. 1*b* is named the "alternative" and that in FIG. 1*a* the "basic" but no further significance is imparted by this choice of names. The stitch forms are loops of two yarns intermeshed into a "seam" of a two-yarn chain stitch.

The close similarity of the stitch forms shown in FIG. 1 can be seen on comparing the path of the shaded yarn 4 past the plain yarn loops 1, 2 and 3. In the "basic" form the shaded yarn passes the yarn loops 1, 2 and 3 on the same face while in the alternative form the shaded yarn 4 passes between loop 3 and loops 1 and 2. The needle motions to produce these forms are described below but clearly other loop passes can be used to produce stitch forms in accordance with the invention, e.g. yarn 4 passing between loops 1 and 2, by modifications of the needle motions apparent to those skilled in the art.

Figure 2:
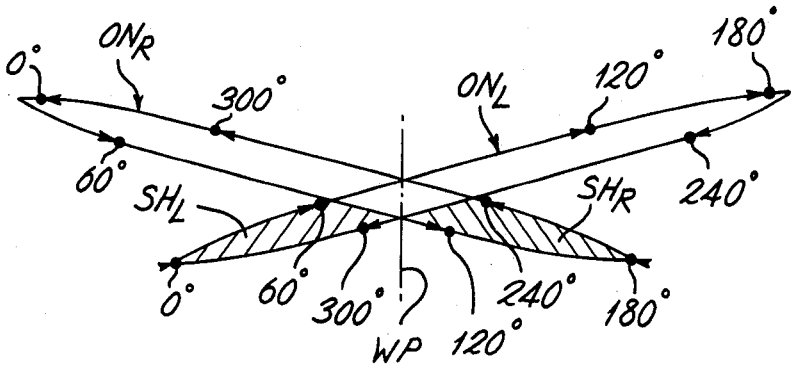
FIG. 2 shows in outline a needle motion to produce the stitch form of FIG. 1*a;*

FIG. 2 shows a needle motion outline diagram to produce the "basic" stitch form. FIG. 3 shows the yarn and needle positions in accordance with the FIG. 2 outline.

Considering FIGS. 2 and 3 together two needles $N_L$, $N_R$ are involved and these reciprocate, with a motion principally lengthwise of the needle, upwardly and towards each other across the warp plane WP which is perpendicular to the drawing plane. Each needle carries a respective yarn $Y_L$ and $Y_R$, and these are respectively plain and shaded in the Figures for clarity. The needles have respective "orbits" of reciprocation $ON_L$ and $ON_R$. In FIG. 2 the orbits are marked out in degrees of one cycle of operation starting from a common zero. In addition to the reciprocation a "shogging" motion, along the warp plane direction, occurs at $SH_L$ and $SH_R$ for needle $N_L$ and $N_R$ respectively. As will be seen from the unequal degree markings, the needle speeds vary during the cycle.

FIG. 3*a* shows the needles and some already knitted stitches CSS at the cycle zero. Needle $N_R$ has passed through a previously formed looped $M_L$ of the stitch chain, which is tensioned down in the warp plane WP. Needle $N_R$ has just passed its leftward excursion extremity as needle $N_L$ commences its rightward excursion.

After 60° at FIG. 3*b* the faster moving needle $N_L$ has entered between needle $N_R$ and the yarn-end tensioned from R to the eye of needle $N_R$. To avoid collision with needle $N_R$ the needle $N_L$ is shogged in a direction forward from the drawing plane, also picking up the shaded yarn to prepare for loop formation. Some tension is required in both yarns, especially to prevent elongation of loop $M_L$.

The continued retraction of needle $N_R$ and shogging and advance of needle $N_L$ over the 60° to 120° interval form the loop $M_R$ (FIG. 3*c*) around needle $N_L$ and its yarn. The needle $N_R$ at 120° is about to cast off the loop $M_L$ onto the running yarn of the needle.

When another 60° have passed to 180°, $N_L$ is just passing its rightward maximum excursion and is supporting the newly formed loop $M_R$.

The tension in yarn $Y_L$ through needle $N_L$ can adjust or control the length of loop $M_L$ between points X and Z. Needle $N_R$ has withdrawn to its righward extremity (FIG. 3*d*).

In FIG. 3*e* needle $N_L$ is now withdrawing more slowly than the advancing needle $N_R$ which is also "shogging" backwards from the drawing plane. Needle $N_R$ picks up the yarn-end $Y_L$ from needle $N_L$ (the reverse of the action in FIG. 3*b*) to prepare a new loop. The withdrawal of needle $N_L$ takes loop $M_R$ away from the advancing needle $N_R$ (FIG. 3*e*).

At 300° the new loop $M_{L1}$ has been formed over needle $N_R$ while the needle $N_L$ has withdrawn to cast off loop $M_R$ (FIG. 3*f*).

After another 60° the starting position is regained, FIG. 3*a*, but two loops $M_R$ and $M_{L1}$ have been formed and added to the two-yarn chain stitch seam, CSS, during the one cycle of operations just described. This production of two loops per cycle gives a potential ability of doubling the conventional production rate of warp knitting loops, which is normally only one loop per cycle.

To produce the "alternative" seam, FIG. 1*b*, the relationship of the advancing needle and the yarn-end suspended from the other needle for pick-up is changed.

FIGS. 3*b* and 3*e* show that to produce the "basic" stitch the yarns are threaded through the needles to pass through the eye of a right-hand needle ($N_R$) in one sense, when viewed from a given position, and through the eye of a left-hand needle ($N_L$) in the opposite sense, when viewed from the given position. If the yarns are threaded so that they pass through the eyes of left and right needles in the same sense (either sense being acceptable) and the shogging motion of the needle is adjusted to ensure looping, then the "alternative" seam is produced (FIG. 1*b*).

It is important to note that the shape of the loops shown in the drawings is diagrammatic. The exact shape of the loops formed in an actual knitting action will, as is well known, depend on the tensions and characteristics of the yarns used. However the yarn paths and crossovers will be as shown, even though the effect of tension may change the appearance.

The actual positions of the yarns during knitting are determined by the tensions maintained by the sources of yarn (not shown) and the pull-down tension on the seam CSS. The yarn is guided by the needle eye alone of a needle which is straight, at least in the pick-up region.

The known knitting techniques, mentioned in the introduction, rely on the sickle shape of the needles to hold a loop in position at the root of the sickle portion and then swing the needle down so that the loop can be pulled over the arch of the sickle. The arch of the sickle is also needed to assist the pick-up needle to penetrate further beneath the yarn-holding needle into the space beneath the arch and thus form the picked up loop near the peak of the arch to slide down to the root away from the needle point. Despite this complex needle form, there is still a need to add yarn-handling elements, as shown in DS-OS Nos. 2,128,075 and 2,128,075, to help with loop formation and ensure the even stitch structure required for quality fabric production. The curved needle form appears to make the exact position of the loop on the arch at pick-up critical as, if placed too near the needle point, the loop could slip off and be lost. The curvature is not great but is downwards both ways from the loop-forming position so loop slip could easily occur, especially as there is no apparent bias either way. In the present technique the loop is formed on a rising needle whose shank is lower than the eye so that to slip off the loop would have to move upwards. Accordingly there is an inherent bias to the correct movement of the loop.

The present technique, by attention to needle motion, achieves quality fabric with a much simpler needle form, almost the conventional form and without beards or latches, and by providing a simple reciprocating cyclic needle motion using, for example, a cam and lever drive, so that the durable drive components have the more complex form and the consumable needle components are as simple as possible. The cyclic motion enables time to be allowed for the critical events, especially yarn pick-up, even when the tolerances on component size are wide enough for economic manufacturing and maintenance costs. Any system of needle motion, whether oscillating or reciprocating, involves reversals of movement but the timings required for the present knitting technique permit a more balanced, smoother motion than conventional techniques, e.g. latch-needle raschel, as well as the oscillating needles described above. FIG. 3*g* shows one form of motion for the present technique. This shows the displacement D, and acceleration A, for the needles shown in FIGS. 3*a* to 3*f* as well as the orbits of the needle points (as in FIG. 2).

A stitch form, called "Locstitch" is described in UKPS 1,268,201. This is a stitch knitted into a base material with a locked-loop pile stitch form. Distinct chains of stitches are formed with loops on both faces of the material by the action of needles and associated "loopers" which create the loops against yarn tension. The base material co-operates by retaining a loop of yarn from a withdrawing needle so that the loop retained can be entered by an approaching needle and have a loop formed through it in turn.

The present stitch is not knitted into a base fabric but is knitted in "space" so the loop is not retained by the base fabric after the needle has withdrawn but is formed over an approaching pick-up needle passing between a yarn-end and the needle supplying that yarn. Furthermore the loop formation is commenced across the warp plane on the side remote from the yarn supply side. FIG. 3*b* shows this commencement of loop formation. The pick-up needle must not engage the loop already on the needle stem.

FIG. 4 shows the yarn layout as the pick-up needle approaches and enables the constraints on successful loop pick-up to be explained. The yarn to be picked up is PY and is shown shaded while the needleheld loop of yarn (which is shown plain) leading to the pick-up needle ($N_L$) is LY. The knitted seam is CSS held by a tension T in the direction of the associated arrow. The pick-up needle tip can securely gather the pick-up yarn by entering area PT. However the pick-up constraints are three-dimensional not just two-dimensional as might appear from FIG. 4. The loop has one leg in almost the same plane as the yarn to be picked up. It is therefore necessary to apply a motion in a direction away from this plane to ensure correct operation. Conveniently this motion is the shogging action described above but clearly other appropriate motions can be devised as described below. Considering the area PT this is defined at one corner EC, the needle eye corner, by the position of the needle eye. However the corners BC and LC are not so rigorously defined as their positions depend on the yarn tensions. Corner BC is the base corner and corner LC the loop corner. Thus, although yarn tension is still relevant, three-dimensional control is available compared with the two-dimensional control known hitherto.

Clearly a mechanism to move the needles in the specified manner is required to produce the described knitted seams. The needle motions can be generated by crank motions with suitable connecting rod lengths apart from the shogging motion which can be cam-generated as it does not occupy a whole cycle. By using eyed needles and careful balancing of the machinery, the present warp-knitting speeds of 1000 courses per minute should be attained at half the speed of a conventional machine as two stitches are formed in each cycle. Alternatively knitting speeds of 2000 courses per minute at present day machine speeds are possible. Careful tension control will ease the use of such speeds. If required back-robbing can be used to control stitch length and uniformity. Friction between yarns can be reduced by providing a yarn groove in the needle but this is not essential to the yarn control exercised by the needle in comparison with the essential channel of the prior art devices. The groove in the present arrangement provides a slot to "hide" the yarn in the needle thickness so avoiding extra friction.

The usage of the stitch seams will now be described. It is assumed that two needle beds are set up to knit several of the two yarn chain stitch seams at once albeit as separate seams.

These separate seams can be used individually. For example one yarn can be an elastic yarn knitted while held in tension so that the other yarn provides a knitted covering for the elastic yarn after release of the yarn tension. Alternatively the two yarns can be of different materials or colours, or arranged to produce a "fancy yarn" effect by different yarn sizes and/or loop length settings. The possibility to combine two yarns of widely differing natures, including material, colour, size, elasticity among others, provides an opportunity for the designer to create new yarn forms by the application of the above described seam knitting techniques. Such yarn seam forms can be included in textile products in any suitable manner to produce different appearance and/or performance characteristics from those possible hitherto. The high production rate of the techniques makes possible the economic supply of the yarn seams.

If required a warp or warps can be laid in during the knitting action. Such a warp could be laid into the chain on each cycle producing the result in FIG. 8, where the knitted yarns are identified as 1 and 2 and the laid-in warps as 3. Alternatively the warp can be laid in selectively to produce any desired repeating or random effect according to the ability of the knitting mechanism.

A multiplicity of seams knitted at one time by banks of needles operated in accordance with the techniques described above can also be formed as a sheet of fabric. FIG. 9 shows one possibility in which both warps WA, alongside the seams, and wefts, WE traversing the seams, are used to link the seams. Clearly the warps and wefts or wefts alone can be added in various arrangements, e.g. diagonally or zig-zag across seams, and inter-relationships as will be apparent to those skilled in the art from the above description and these variants will not be described further. Also the appearance and behaviour of the fabric sheet can be selected by using the basic or the alternative seams or even a mixture of these.

Instead of adding warps and wefts the techniques described so far can be extended to bring about connections between the seams using the seam yarns. This extension has a possible benefit of reduction of yarn usage compared with the added wefts and warps. By increasing the shogging action of the needles to achieve seam interaction a yarn from one seam can be knitted into another seam for one or more courses. The seams then become wales of a sheet of knitted fabric. FIG. 10 shows one possibility in which an increase of one wale width in the shogging action produces loops intermeshing the wales. The shogging increase can clearly be of more than one wale width if the mechanism and timing permit it. Also the increase can vary from course to course, as shown by the shaded yarns in FIG. 11. It appears to be desirable that the nett shogging excursions should be zero over a length of fabric but this may not prove to be essential in practice.

As mentioned above warps and wefts may be introduced and the basic and alternative stitch forms employed as a designer of the fabric requires.

A knitting mechanism to produce the seams described above will now be described. This mechanism is an example of the mechanisms that may be devised and used and is not a limitation on the scope of the claims of this specification.

The needle motions are an important part of the knitting mechanism and various techniques such as deriving all the motions from a single shaft are possible. However as three-dimensional needle motion is required (see FIG. 3) a transverse drive shaft is provided for the shogging motion.

Preliminary knitting trials showed that the knitting quality improved as seam take-down tension was increased. This however could lead to yarn breakage by back-robbing of knitted loops as well as overlong stitches. The accurate and repeatable formation of the pick-up triangle is important for reliable knitting at usable tensions. One way to stabilize the pick-up triangle is to provide a single "presser bar" for each needlebank and drive it in time with them. This "presser bar" is arranged to push loops off the withdrawing needle and onto and then along the pick-up needle to an accurately repeatable selected position on the needle shank. The use of this presser bar reduces the take-down tension needed for highly reliable knitting quality but the tension is still a little high. Also inconsistency of yarn can upset the knitting, even if the yarn is still within normal limits for slubs, knots and the like. Once a stitch is dropped the next stitch must fail as do all subsequent stitches. The presser bar is related to loop corner (LC) stability.

An important aspect of the invention provides control of base corner (BC) stability. By providing additional elements of the knitting machine to position the base corner all the corners of the pick-up triangle are positioned by machine elements and the yarn and seam tensions will have less or no effect.

The additional element is called a "grabber" and supersedes the presser bar. The grabber G has an L-shaped form (see FIGS. 5, 6 and 7) with a stem GS and a nose GN. The grabbers are positioned between the needles, which are cranked in the non-working shank portion to allow the grabber nose to come up between them. FIGS. 5*b* and 5*c* show how the grabbers move around the needles during the loop forming cycle for the alternative seam and the general form of the grabbers and needles. To permit the grabbers to move between the needles and allow the grabber to lie across the needle to push picked up loops down the needle the needle shanks are cranked, in the non-working area, and the grabbers aligned with the cranked part. Each bank of grabbers in turn can then rise through the needles to push down loops and at another point in the cycle engage and locate base corner (BC FIG. 4) of the pick-up triangle beneath the needles. In the Figures these needles which, without a shogging movement, would together knit a seam are indicated by the same suffix letter, e.g. NLB, NRB are the left and right needle respectively.

In the figures, FIG. 5*b* shows the general arrangement of one pair of needles ($N_R$ and $N_L$) and the associated grabbers ($G_R$ and $G_L$) when grabber $G_R$ is positioned to locate directly with its stem the base corner of the pick-up triangle and indirectly to push the loop down needle NL. FIG. 5*c* shows the general arrangement when grabber $G_L$ is lying across and spaced from the needle $N_L$ with a loop formed on the needle ready to be moved along by the grabber as the needle continues to withdraw. Clearly in other parts of the cycle grabber $G_L$ is effective to position a base corner and loop and grabber $G_R$ effective to move a loop along needle $N_R$. The grabber nose thus moves over the needle shank, pushing the loop off, and then moves the yarn to be picked up to a selected position (300°–360°, FIGS. 3*f*–3*a*). The grabber stem is then positioned to hold the next yarn to be picked up in a chosen position whether or not the previous stitch has been formed correctly.

The grabbers perform a further function in that, at start-up, once the yarns are threaded through the needle eyes the grabbers carry the loose yarn into the knitting zone and knitting commences. The yarns do not need to be taken round the take-down rollers. Additionally the grabbers can handle weft-inlay yarns to tie seams together as described above.

By adding the grabbers it is possible to control stitch setting, as well as ensure pick-up as just described. Two forms of stitch control are available. The first form is indicated in FIG. 5*a* by the arrows GH. These represent a parameter "grabber-height" which, when varied along the direction of the arrows GH, dictate the amount of yarn drawn into each stitch through the needle eye. The second form of control is achieved by regulated "back-robbing" of yarn by moving the needle forward across the warp plane with the yarn unable to feed so that yarn is pulled back through the needle eye. This draws yarn from the fabric reducing the size of the latest course of loops and tightening them (i.e. loop ML). The grabber in position ensures that the portion of yarn to be picked up (PY FIG. 4) is kept in place while yarn from this portion is drawn back round the grabber.

The presser bars proposed hitherto cannot interact with any shogging actions as they form a continuous element along the needle bed. However the individual grabbers can achieve such interaction. The pick-up triangle can be tilted sideways by the relative movement of shogged needles and stationary grabbers. This could permit seam interaction to produce sheets of fabric with or without inlaid warps and/or wefts.

By using the individual grabber elements the approximate triangle positioning possible with suitable control of yarn feed tension and fabric pull-down tension is replaced with a precise control of triangle position and form and the reliable weft-wise tilt of the triangle.

Drive layouts have been devised for the needle and grabber motions and for their shogging. The shogging for weft-wise intermeshing of seam loops to form a fabric by seam interaction is provided by suitable cams having appropriate profiles which augment the basic shogging. FIGS. 12 and 13 show respectively the linkages for the lefthand needle and grabber motions while FIG. 14 shows the linkages for shogging these elements. The righthand needle and grabber motion linkages are clearly similar with appropriate changes for the other hand as the left and righthand halves are essentially mirror images. The drives are not shown in constructional detail as suitable forms would depend on machine form and can in any case be readily devised to achieve the movements shown. Clearly also other movements could be effective to produce knitting with or without grabbers and/or presser bars, the above being an example capable of producing fabric with considerable reliability of stitch form A specific machine is described below.

Attention must also be given to the selvedge. When making fabric on the full width of the needles (all threaded with yarn) spring take-up compensators are provided for those yarns supplied to end needles shogged out of interaction. The compensators take up unused yarn and a very satisfactory selvedge results.

The movements are those for the "alternative" stitch form as this requires a smaller ($\frac{2}{3}$) and slower ($\frac{1}{2}$) peak velocity than the "basic" form. "Basic" fabric has the same appearance both sides if suitably tensioned similar yarns are used. "Alternative" fabric is inherently or a different appearance on each side.

Using a light weight test rig, based on acrylic plastics materials for visibility and ease of construction, fabrics of up to six inches wide have been knitted at 600 revolutions, i.e. 1200 courses of loops, per minute. These fabrics have been knitted in staple-spun acrylic using seam loop intermeshing produced by a one pitch shog (i.e. one wale width) per needle per cycle.

Some faults occurred in the experimental knitting. These were both regular, in a seam, and random; while some seams do not show any faults. "Pliering" of elements to more accurate positions reduced the regular faults leaving the random faults. The absence of random faults from a significant number of seams points to a specific cause for the random faults, other than yarn defects and the like. Despite the use of the grabber some variation of the position of an already knitted yarn loop can occur, especially the length of the loop. The variation can affect base corner positions during the return shot and lead to a faulty stitch. However the grabber limits the fault to one stitch by ensuring a correct position for the next pick-up.

In this way the grabber is effective to prevent "runs" of failed loops thus reducing wastage of material.

FIGS. 5*a*, 5*b* and 5*c* show the action of the needles and grabbers when knitting separate seams of "alternative" loops. The needles NLB, NLC are cut away to show the grabbers for the next needle along (NCA, NLB respectively) and their effect in controlling yarn portion LY to position the loop yarn on needles NR while yarn portion PY is positioned to be readily picked up by the approaching NL needle by the take-down tension on the already knitted loops. Even if a loop is dropped the portion PY is still kept in position.

FIGS. 6 and 7 show the seam interaction knitting action for the "alternative" form. In FIG. 6 a single pitch shog has just occurred, from left to right, arrow S1. The base corner BC of the pick-up triangle PT is very accurately controlled by the grabbers, e.g. GL, as both the pick-up yarn PY and loop yarn LY are retained in place by mechanical components. It will be observed that the needles in one group are interacting with needles initially one pitch away. After a return shog (FIG. 7) from right to left, arrow S2, the needles are interacting with needles initially two pitches away and a different element relationship exists. The base corner BC is still controlled by the grabbers but the pick-up yarn is now controlled predominantly by the loop yarn LA. The loop yarn LA is controlled by the take-down tension T which results from the action of the take-down rollers several courses below.

A machine for knitting fabric in accordance with the techniques of the invention will now be described. Basically the machine is built between parallel side frames of upright generally triangular sheet form spaced and stiffened by cross-members spanning the space between the frames. A needle assembly is positioned across the machine between the apices of the spaced frames and the machine is generally symmetrical about the needle assembly. Yarn is supplied to the needles from a rack of bobbins at one end of the machine. The yarns to supply the needles remote from the rack side pass under the machine so that all the yarns Y follow similar paths along the lines of the sloping frames from the ends of the machine to the needles in the middle. The knitted fabric is drawn vertically downwards from the needles in the middle of the machine. The yarns are spaced by a yarn spacing reed YS.

FIGS. 15, 16, 17 show various parts of the machine. For clarity many of the conventional supporting parts have been omitted or cut away but suitable forms for these will be readily understood and supplied by those skilled in the art.

As the needles and grabbers, in this embodiment, must both execute reciprocal and lateral movements in three dimensions, suitable rigid and precise drive mechanisms are essential. FIGS. 15 and 16 show how the needles and grabbers are supported and linked to their drives and also the reciprocal drive mechanisms. The lateral drive mechanism is shown in FIG. 17. The drives are all by linkages which are crack drive where possible and otherwise cam driven.

As seen in FIGS. 15 and 16 the needles and grabbers are supported as respective needle bars NB1, NB2, and grabber bars GB1 and GB2. (The needles and grabbers can be secured in the conventional manner by being mounted in groups in blocks of metal bolted along a rigid platform NP1 to form the needle and grabber bars). The needles are cranked, see FIGS. 5*b* and 5*c*, and held in angled slots in the blocks so that opposed needles are able to mesh. The angled slots can also form yarn guides, YG.

Platform NP1 is supported on a needle slide NS1 for controlled low friction motion to and fro across the machine (FIG. 16). The needle slide NS1 is in turn supported on a pair of linkages NL1, NL2, from a drive shaft DS1 journalled at one outer end of the frames F1, F2; (another drive shaft, DS2 not shown, is provided at the other end of the frames F1, F2). The two drive shafts are driven in a synchronised matter, e.g. by a toothed belt (not shown), from a common drive unit such as a variable speed electric rotor. The linkages NL1 and NL2 are pivotted on a pivot shaft PS1 which extends across the machine between pivot bearings such as PB in the frames F1, F2. The needle slide NS1 is bolted to the ends of the pair of linkages NL1, NL2 by link bolts LB. The linkages NL1, NL2 are connected to the drive shaft DS1 by eccentrics NE1 (and NE2 not shown) inside the end part of the linkages. The arrangement of the linkages NL1, NL2 is as shown in FIG. 12, where the drive shaft DS2 and pivot shaft PS2 are identified, to bring about a reciprocal motion of the supported needles by the bodily movement of the needle slide NS1. FIG. 12 shows only the lefthand half of the machine, the righthand half is symmetrically similar. The needle platform NP1 is retained on the needle slide NS1 by clamp plates CP and is movable along the slide. The needle linkage NL1, NL2 is stiff and massive and sturdily supported in the frames F1, F2 so the movement of the needle slide is closely controlled without significant slackness to provide a precisely positioned mounting for the needle platform NP1. In this way the working together of the needles of the two needle bars is reliably achieved without risk of clashing. Also the movement is precise enough to permit the introduction of the grabbers among the moving needles.

The needles are subjected to the yarn tensions, but the grabbers are not, so the grabbers can be less strongly supported than the needles while retaining sufficient precision in their movement. The grabber bar GB1 is mounted on a grabber platform GP1 in conventional manner. The grabber platforms GP1, GP2 are in turn supported by flexible elements, grabber spring mounts GS1, GS2. The spring mounts comprise sheet metal springs of waisted shape, two at each end of each platform. These provide adequate flexibility for the limited shogging required of the grabbers. The needles, which are required to shog several needle pitches for seam interaction, require the more complex slide support described above. This embodiment knits the "alternative" fabric.

FIG. 15 is a general view of parts of the machine, apart from those providing lateral drive, and FIG. 16 is a more detailed view of the needle support shown in FIG. 15.

As can be seen from the general view and detailed scrap cross section in FIG. 16 the needle support is similar in form to a machine tool slide support and similar techniques are suitable for its material and manufacture. Conveniently the force to move the needle platform NP1 along the slide NS1 is transmitted from drive rod ND1 by a self-aligning rod end joint J to a stud ST fitted to platform NP1. A slot SL lengthwise of slide NS1 allows the stud to move to and fro with the movement of drive rod ND1 to produce the lateral needle motions.

The self-aligning rod end is conveniently adjustable on rod ND1 to enable the stroke of the needle platform to be set up precisely. The adjustment may be a screwed rod end and lock nut arrangement.

A similar linkage is used between the grabber drive rods GD1, GD2 and the respective grabber platforms GP1, GP2.

The grabber platforms are reciprocated by linkages GL1 (and GL2 not shown) similar in general form to the needle platform linkages NL1, NL2. However the grabber linkages are controlled from the respective drive shaft, e.g. DS1, by cams such as GC1, GC2 on drive shaft DS1, which are traversed by followers GF1, GF2, connected to the linkage elements. The arrangement of the linkages is as shown in FIG. 13 again for the left hand half only, as in the case of FIG. 12. It is observed that for each needle and grabber linkage two inputs from the drive shaft are used to produce the required reciprocal motion having a speed varying within each cycle. Thus cam GC1 has two elements GC1A, GC1B and eccentric NE1 has two elements NE1A, NE1B. The other levers and links are not described in detail as their form and, where significant, dimensions can be seen in FIGS. 12, 13, 15 and 16. The need for initial precision and long-term stability of the mechanism is emphasised. For this reason the crank and cam drive linkages are provided.

Reference has been made above to the lateral (shogging) motion of the needles and grabbers and FIGS. 14 and 17 show the mechanism to provide this motion for the embodiment illustrated in FIGS. 12, 13, 15 and 16. The mechanism is positioned on the main frame MF of the machine at the side and aligned with the needle and grabber assemblies. The frames F1 and F2 are attached to the main frame MF. In this way the linkages ND1, ND2, GD1, GD2 have a substantially straight line connection between the needles and grabbers and the mechanism to generate the lateral motion.

The mechanism is housed between two side frames SF1, SF2, spaced and secured together by plates P1, P2 to form a stiff structure holding an assembly of cam followers and levers. The mechanism has two mirror-image parts for the left and right sides of the machine and is shown separated into these parts in FIG. 17. In use the whole is a compact unit. Each part provides a needle drive and grabber drive for one half of the needle/grabber assembly.

The whole mechanism is driven by a main shaft MS from the same drive-train as the drive shafts DS1, DS2. Suitable gearing to provide a movement strictly in phase with the needle and grabber reciprocation is required but this is not shown as it is readily apparent to those skilled in the art. Suitably the whole drive-train is powered by a variable-speed electric motor (not shown) mounted on the main frame.

The main shaft carriers a gear G1, G2 (not shown) adjacent each side frame SF1, SF2 and fixed on the shaft. The shaft MS also provides a pivot for a pattern follower lever PL1 (and matching lever PL2) which supports pattern follower PF1 (and PL2 similarly PF2) to respond to a pattern chain or cam PC1 (and PC2 not shown).

Follower lever PL1 supports a cam NC1 and follower and link NF1. The cam NC1 is driven from gear G1 by gear G2. Follower and link NF1 thus executes a total motion depending on the combined action of the pattern chain PC and NC1. Cam NC1 is designed to provide the lateral needle motion for knitting a basic or an alternative seam. Chain or cam PC1 is designed to provide the additional lateral motion, shogging, for seam interaction. The seam interaction motion may be varied from cycle to cycle of the knitting action to vary the seam interaction. In this way open work and similar effects can be produced. This total motion is available at the clevis at the end of link NF1 to which the link rod ND1 to the needle platform NP1 is attached with a self-aligning rod end. This permits the toal motion of the link NF1 to be transmitted despite the reciprocal motion of the needle platform NP1 produced by the drive shaft DS1.

The grabbers are driven in a similar manner. Cam GC2 is fixed on shaft MS and is followed by a follower and link GF2 pivotted on side frame SF2 to provide an output motion to grabber drive link GD2. The grabber drive in this embodiment does not need a component related to seam interaction as the grabber motion is the same whether or not interaction occurs although in some arrangements such a grabber drive component may be needed. Grabber drive link GD2 is connected by using a self-aligning rod end as before.

The forms and sizes of the cams and links are shown in FIG. 14. It will be understood that in the description of the mechanism in FIG. 17 only one drive of each type has been described, the other in each case being similar and not requiring description.

The machine also includes yarn supply and fabric take-down arrangements which can be of any conventional form linked to and driven by the main drive train as appropriate. Back-robbing when required is effected by back-robber BR driven by link BRL. Synchronism of the drive shafts DS1 and DS2 is conveniently provided by a toothed belt arrangement in the drive train.

Conveniently a single, variable-speed motor drives the gear train to operate all the machine elements in their proper order as set by the selected meshing of the gears and motions of the linkages.

The exact form of the machine is not essential to the operation of the technique, but the various critical parameters and precautions identified so far in the construction and operation of machines to employ the techniques have been indicated so that those skilled in the art can implement the techniques.

The grabber motion illustrated in FIGS. 13 and 14 was designed by using a computer to generate the cam sets for the linkage to produce the grabber motion required to hold the yarn in the pick-up position. In this way the linkage can be designed to allow for the interaction of the cams controlling the grabber motions in the x and y directions (as indicated in FIGS. 12, 13 and 14). The z direction motion was also designed using computer techniques to produce the required precision where a grabber moves around the crank in a needle which is itself moving in three dimensions. By way of a computer the machining information for cam profiles can be generated directly as polar co-ordinates for numerically controlled machine tools.

The following tables give the values in inches for dimensions identified in FIGS. 12, 13 and 14. Angles are given in degrees. The datum point for the various motions is indicated at DP. Directions x, y and z are respectively horizontally transverse to the fabric plane (WP), vertically in the fabric plane and horizontally in the fabric plane (along the weft or machine axis).

In FIG. 12 NX and NY represent the co-ordinates of motion of needle point N. V is the point at which the needle bar shogging drive is effective and VX and VY are the co-ordinates of its motion.

In FIG. 13 the co-ordinates of grabber displacement are GX and GY where G is the position of the grabber. BX and BY are the co-ordinates at which the grabber bar shogs.

FIG. 14 shows an elevation, and a plan in direction XX, of the shogging drive and linkage. The grabber tie bar is indicated at GD and the needle tie bar at ND and the co-ordinates of grabber and needle drive for shogging as before. The shogging amplitude depends on the seam interaction required and is indicated at +Z and −Z.

TABLE FOR FIG. 12

| | |
|---|---|
| A = 0.094 | P = 7.000 |
| B = 6.820 | Q = 4.030 |
| C = 2.000 | R = 0.312 |
| D = 2.500 | S = 3.032 |
| E = 2.445 | T = 1.757 |
| F = 9.225 | U = 1.726 |
| G′ = 11.844 | |
| H = 3.732 | |
| $\theta$ = 90° | |

TABLE FOR FIG. 13

| | |
|---|---|
| A′ = 2.375 | L = 6.820 |
| B′ = 1.352 | M = 2.687 |
| C′ = 4.210 | N = 2.040 |
| D′ = 3.383 | P = 7.000 |
| H = 3.732 | Q = 4.030 |
| J = 6.820 | V′ = 2.687 |
| K = 2.637 | W = 0.748 |
| $\theta_1$ = 12.13° | $\theta_2$ = 167.56° |

TABLE FOR FIG. 14

| | |
|---|---|
| A″ = 8.364 | K″ = 0.748 |
| B″ = 12.940 | L″ = 3.625 |
| C″ = 1.875 | M″ = 0.732 |
| D″ = 5.143 | N″ = 1.005 |
| E″ = 3.553 | P′ = 7.127 |
| F″ = 1.437 | P″ = 1.187 |
| G″ = 3.534 | R″ = 5.982 |
| H″ = 2.557 | S″ = 1.500 |
| J″ = 2.437 | |

FIGS. 18 and 19 show in outline another embodiment of the invention. In this embodiment the needles are caused to execute a straight line reciprocation for seam knitting, the yarn being manipulated in the lateral direction solely by a comb of elements, which can also produce seam interaction. If required, the needles can be shogged in the plane of reciprocation for more complex seam interaction. The plan view in FIG. 19 shows one group of needles, LN, moved forward and the other, RN, retracted. Similarly one comb, CR, is swung forward and the other, CL, backward. The arrows indicate the motions. The knitting action is, as described previously, a yarn passing through one needle eye (vertical in this embodiment) being picked up by an advancing needle to form a loop over the needle which loop is subsequently shed onto the yarn passing through the pick-up needle to provide a course of knitting. The lateral motion of the yarns in the knitting area is here provided only by the combs which move to control the pick-up triangle and seam interaction without the need to provide lateral needle motion. This simplifies the motions required. It is noted that the angle between the needles in this embodiment is approximately 90° while in the other embodiment an angle of some 140° is suitable.

Other needle forms such as notches behind the eye and yarn grooves can be used, for the various embodiments mentioned, to improve needle clearance tolerance and pick-up accuracy.

FIGS. 20 and 21 show in outline a further embodiment of the invention in which the needles are in the form of circular arcs and are caused to move along the line of the arcuate form of the needle, the needles being straight, i.e. uncracked, apart from the curvature described.

In FIG. 20 the needle banks LNB and RNB are shown in end elevation. The needle banks are placed on opposite sides of the warp plane WP and arranged to pivot about the centres of curvature CCL, CCR of the respective needle arcs. The pivot positions are above the loop forming area and away from the direction in which the chains of linked loops, or the knitted fabric of weft-wise linked loops, is pulled-down. This pivot position permits the use of curved needles which are shaped to maintain a constant loop length from the knitting area and therefore constant loop tension. This constant tension is an advantage in that it helps to produce regular knitting.

In the embodiment illustrated in FIGS. 20 and 21 the needles only execute the principal motion of lengthwise reciprocation. Yarn control is by comb elements LCB, RCB which shog to bring about looping and by shogging further can cause seam interaction to produce knitted fabric. The comb elements have teeth LCT, RCT spaced at needle pitch and extending from a continuous base LCB, RCB. The continuous bases act as take-down guides for the knitted material (not shown). The comb elements are driven to move into and out of engagement with the needle banks and to shog by the required number of needle pitches by any suitable mechanism.

The knitting action is now described with reference to both FIG. 20 and FIG. 21, which is a view of some of the elements of FIG. 20 in a loop forming relationship.

FIG. 20 shows that the needle banks can reciprocate to cause the needles of the two banks to intersect at the warp plane WP. The yarn control elements move up to and away from the warp plane to move the yarn-ends from one bank of needles for pick-up by the other bank.

As shown in FIG. 20, by the full line drawing, which represents one point in the start-up of a cycle, the yarn control element LCM for the lefthand needle bank LNB is moved into position to co-operate with this needle bank while it is in the region of the warp plane WP. Meanwhile the other needle bank, RNB, and control element RCM are remote from the warp plane. The cycle continues to the position shown in perspective in FIG. 21. In reaching the FIG. 21 position, the left needle bank has swung to its extreme righthand excursion while the righthand needle bank RNB has moved to the left to place its needles between those of the lefthand bank, from which positions the comb elements have moved. In this movement the comb elements have shifted downward and tilted, in the plane of FIG. 20, and also moved forward (shogged) from the plane of FIG. 20 to hold the yarn-ends from the lefthand needle bank (plain in the drawings) across the path of the approaching righthand needles with their shaded yarn-ends. The comb tooth LCT1 (shown partly cut away) would have been just in front of lefthand needle LNB1 with tooth LCT2 just behind needle LNB1. Righthand needle RNB1 now passes between these teeth to pick up the yarn held inclined across the path of needle RNB1. In the position shown in FIG. 21, the righthand needles have passed under the yarn-ends of the lefthand needles and are just beginning to pick up the yarn-ends to form the loops while the position of the yarn-end in the warp plane is controlled by the position of the comb teeth LCT and base LCB as mentioned above. Continued leftward motion of the righthand needles and later of the lefthand needles ensures proper yarn pick-up and later loop formation in the same general manner as the other embodiments described above.

An important feature of the process and apparatus shown and described in FIGS. 20 and 21 is the constancy of loop length and tension possible with the movement of the needles in their own arc of curvature as the needle part in contact with the loop can be at a constant distance from the linked loops already produced. This constant length and tension clearly improves the quality of the knitting produced.

After loop formation on the righthand needles these hold the loops on the needles and the cycle continues with loop formation on the other (lefthand) needles with the assistance of the righthand comb RCM and the shedding of the loops held on the righthand needles.

The inward face of the base part (LCB, RCB) can be used as a take-down guide for the knitted material to locate the material in the warp plane and maintain the conditions for minimal or no variation of loop length and tension.

Suitable drive means to bring about the required non-constant and synchronised motions will be apparent from the descriptions of the other embodiments.

The techniques described above are particularly suitable for yarns which are difficult to knit in conventional machines as the mechanism is very tolerant of fluff and yarn irregularities as are met on short staple yarns and yarns of unusual materials such as fibre glass, carbon fibre and other artificial fibres. The technique is very suitable for producing open-weave fabric for dressings and bandages and reinforcement for resin-impregnated composites. The knitting can be as fine as conventional work as the needle forms are relatively straightforward to make by conventional techniques to any required fineness.

We claim:

1. A knitting process in which a first yarn is fed through an eye of a first needle and a second yarn is fed through an eye of a second needle, links are formed by the first needle being moved relatively to the second needle so that its eye passes between the second needle and a section of the second yarn, and the second needle being withdrawn so that the second yarn forms a loop on the first needle, after which the second needle is moved relatively to the first so that its eye passes between the first needle and the first yarn, the first needle then being retracted so that (a) the said loop is cast off the first needle and (b) the first yarn forms a loop on the second needle this process being repeated to form successive links between the cast off loops, the needles reciprocating at least principally lengthwise of themselves, a pick-up triangle being formed between needle, loop and yarn having a base corner where the yarn and the loop meet at the last-formed link, and the base corner position is mechanically controlled with respect to the needle to ensure link formation.

2. A process according to claim 1 including providing a plurality of needles and arranging them in opposed banks to operate the process to produce a plurality of sequences of warp-wise linked loops.

3. A process according to claim 2 including manipulating the yarn-ends to produce weft-wise linking of picked-up loops of the sequences of warp-wise linked loops as a knitted fabric.

4. A process according to claim 3 including mechanically manipulating the yarn-ends by at least one of relative side-to-side movement, shogging, of the needles, yarn control elements and a combination of both actions.

5. A process according to claim 3 including manipulating the yarn by yarn control grabbers, both to knock-over the loops and to hold yarn to be picked up by a needle to control the base corner position of the pick-up triangle.

6. A process according to claim 2 including arranging two groups of needles as opposed banks, reciprocating the banks to cross one another and causing at least one group to shog at least one needle space to link picked-up loops weft-wise as well as warp-wise as a knitted fabric.

7. A process according to claim 6, comprising controlling the position of the base corner positions of the pick-up triangles based on the needles of each group by grabber yarn control elements.

8. A process according to claim 1 in which two groups of needles are caused to reciprocate without a shogging motion along crossing axial paths, providing two associated groups of yarn control elements and causing them to shog to move linked loops of yarn at least one needle space to link picked-up loops weft-wise as well as warp-wise as a knitted fabric.

9. A process according to claim 8 including providing straight needles and reciprocating them along their length.

10. A process according to claim 8 including providing curved needles and reciprocating them along their curvature.

11. A knitting apparatus comprising first and second needles provided with eyes through which yarn can be fed, needle reciprocating means for moving said first and second needles relatively of one another so that the eye of the first needle passes between the second needle and a section of yarn fed through the eye of the second needle and to withdraw the second needle so that the yarn fed therethrough forms a loop on the first needle, thereafter moving the second needle relatively to the first so that its eye passes between the first needle and the first yarn, and for retracting the first needle so that the said loop is cast off the first needle and the first yarn forms a loop on the second needle, and for performing said movements repetitively to form successive links between the cast off loops, said needle reciprocating means reciprocating said needles at least principally lengthwise of themselves, there being formed, during said movement, a pick-up triangle between the needle, loop and yarn, said triangle having a base corner where the yarn and loop meet at the last-formed link, and base corner control means controlling the position of the said base corner with respect to the needle whereby to ensure link formation.

12. An apparatus according to claim 11 in which needles are straight, at least in the part used for yarn manipulation.

13. A knitting apparatus according to claim 11, comprising opposed banks of said first and second needles.

14. An apparatus according to claim 13 in which the needles are moved in crossing orbits around the principal motion, including motions laterally, and transversely of the needles in the bank.

15. An apparatus according to claim 11 in which one needle and the other needle are each inclined at an acute angle up from the horizontal.

16. An apparatus according to claim 15 in which the said angle is less than 45°.

17. An apparatus according to claim 13 in which the base corner control elements are in the form of combs, one beneath each group of needles, which groups are arranged to intersect at right angles.

18. An apparatus according to claim 17, comprising means for shogging the combs to place a yarn-end for pick-up to form a loop.

19. An apparatus according to claim 18 in which the needles are arranged for motion only in a lengthwise direction.

20. An apparatus according to claim 19 in which the needles are straight and the motion is along the straight line in which the needle lies.

21. An apparatus according to claim 19 in which the needle is curved to a circular arc form, and the motion is along the circular arc in which the needle lies.

22. An apparatus according to claim 17 in which the combs include portions to form yarn take-down guides.

23. A knitting apparatus including spaced side-frames, opposed drive mechanisms supported between the side-frames together with yarn-supply means and knitting pull-down means, opposed needle-banks supported by the drive mechanisms for co-ordinated drive thereby in a principal motion of reciprocation lengthwise of the needles in each bank and towards the opposite needle bank, the drive mechanisms also including means to drive the supported needle banks in a subsidiary motion to cause the needles to move in orbit around the longitudinal direction, slide means in the supports of the needle banks for the drive mechanisms to permit shogging motion of the needle banks laterally of the direction of the principal motion and shogging drive means to drive the needle banks in said lateral direction, yarn-control elements flexibly supported by the drive means for drive by the shogging drive means in said lateral direction, the drive mechanisms including cam means and linked lever means to produce cyclically said principal and orbital motions of the needle banks with a variation of the needle speed in a cycle, the needle movements taking the needles of each bank in turn between the needles of the other bank to execute a knitting action linking loops formed in yarn supplied to the needles and the apparatus including means to synchronise the action of the drive mechanisms with the action of the shogging drive means to produce lateral interaction of the knitting action on the supplied yarn to form in operation a knitted fabric.

24. A knitting apparatus including opposed groups of needles arranged in banks each needle curved in a circular arc out of the plane of the banks, means to support the opposed banks and reciprocate them towards one another at a non-constant speed along the arcs of curvature of the needles in the banks, yarn control means outside these arcs of curvature with means to drive the yarn control means into and out of the reciprocating needle banks and to drive the yarn control means along the needle banks, when disengaged therefrom, in a yarn knitting action, yarn supply means, means to draw yarn-ends from the supply through the needles for knitting action by the operation of the needles together with yarn control means, the yarn control means being arranged to hold yarn being drawn from the needles of one bank across the path of approaching needles of the other bank for the approaching needles to pick up and form respective loops with the yarn on their yarn as the yarn knitting action.

25. An apparatus according to claim 24 in which the yarn control means has the form of a comb, that is teeth on a support member with the teeth at the pitch of the needles, the teeth to receive yarn extending from the needles and the support member to enable the control means to hold the received yarn for needles of the other bank to pick up.

26. An apparatus according to claim 25 in which the yarn control means also forms a take-down guide for knitted yarn.

27. An apparatus according to claim 24 in which the needles move in their arc of curvature to maintain constant loop conditions.

28. An apparatus according to claim 11 which includes base corner control elements is the form of grabbers, interdigitated with the needles in a bank and supported for movement in relation to the needles in the bank and about the needles to pass over a needle to move a loop along the needle and to hold yarn passing to the take-up means in a controlled position for linking in loops by a needle.

29. A knitting apparatus including opposed banks of yarn-looping needles each supported for reciprocal movement in a straight line, the lines crossing, means to supply yarn to the needles and means to tension and take up yarn from the needles and yarn control elements supported for movement sideways of the needles with yarn from the needles, the arrangement being such that yarn supplied to a needle of one bank is linked in loops with yarn supplied to a needle of the other bank by the continued motion of the needles in crossing reciprocal motion and the movement of the yarn control elements producing in operation seams of linked loops.

30. An apparatus according to claim 29 arranged to produce knitted fabric by the sideways movement of the needles and the yarn control elements being extended to bring about weft-wise linking of seams of picked-up loops.

31. An apparatus according to claim 29 including means to lay yarn into the seams, and any fabric formed by interaction of the seams, in at least one of a warp and a weft-wise sense.

32. A knitting process in which two opposed groups of curved needles are caused to reciprocate along crossing arcs coincident with the curvature of the needles to form by the process linked yarn loops outside the arcs, and two associated groups of yarn control elements are caused to shog to move yarn-ends from one group of needles across the approaching needles of the other group for pick-up by said other group needles to form linked loops of yarn.

33. A process according to claim 32 in which the yarn control elements also control the position of the yarn-end in the plane of curvature of the needles with respect to the warp-plane.

34. A process according to claim 8 where linked loops are formed by the shogging action of the yarn control elements and in which at least one needle group is selectively shogged in addition to produce selected seam interaction in a fabric.

35. An apparatus according to claim 23 including patterning means for the shogging drive means to selectively control the lateral interaction of the knitting action to form in operation a patterned knitted fabric.

* * * * *